US009672765B2

(12) United States Patent
Cote et al.

(10) Patent No.: US 9,672,765 B2
(45) Date of Patent: Jun. 6, 2017

(54) SUB-PIXEL LAYOUT COMPENSATION

(71) Applicant: Apple Inc., Cupertino, CA (US)

(72) Inventors: Guy Cote, San Jose, CA (US); Mahesh B. Chappalli, San Jose, CA (US)

(73) Assignee: APPLE Inc., Cupertino, CA (US)

( * ) Notice: Subject to any disclaimer, the term of this patent is extended or adjusted under 35 U.S.C. 154(b) by 65 days.

(21) Appl. No.: 14/871,894

(22) Filed: Sep. 30, 2015

(65) Prior Publication Data

US 2017/0092174 A1 Mar. 30, 2017

(51) Int. Cl.
*G09G 5/10* (2006.01)
*G09G 3/20* (2006.01)

(52) U.S. Cl.
CPC ... *G09G 3/2003* (2013.01); *G09G 2300/0452* (2013.01); *G09G 2320/0242* (2013.01); *G09G 2320/0271* (2013.01); *G09G 2320/0285* (2013.01); *G09G 2320/0626* (2013.01)

(58) Field of Classification Search
CPC ..... G09G 3/2003; G09G 2320/0242; G09G 2320/0271; G09G 2320/0285; G09G 2300/0452; G06T 5/005; H04N 1/6058; H04N 5/3675
See application file for complete search history.

(56) References Cited

U.S. PATENT DOCUMENTS 6,856,704 B1 2/2005 Gallagher et al.
8,224,076 B2 7/2012 Lin et al.
8,971,659 B2 3/2015 Forutanpour
2008/0158454 A1* 7/2008 Shin ..... G09G 3/3607 349/36
2013/0147858 A1* 6/2013 Omoto ..... G09G 3/30 345/690
2013/0153876 A1* 6/2013 Minami ..... G09G 3/3233 257/40
2014/0183481 A1* 7/2014 Lee ..... H01L 27/3213 257/40
2015/0030247 A1 1/2015 Shu et al.
2015/0090985 A1* 4/2015 Park ..... H01L 27/3246 257/40
2015/0170578 A1* 6/2015 Choi ..... G09G 3/3266 345/212
2016/0224157 A1* 8/2016 Yang ..... G06F 3/044
2016/0351096 A1* 12/2016 Tani ..... G09G 3/006
2017/0004765 A1* 1/2017 Tani ..... G09G 3/3225

* cited by examiner

*Primary Examiner* — Joe H Cheng
(74) *Attorney, Agent, or Firm* — Fletcher Yoder PC

(57) ABSTRACT

Devices and methods for reducing or eliminating sub-pixel layout artifacts on an electronic display are provided. One such device may include an electronic display to display image data, a processor to generate the image data, and sub-pixel layout compensation circuitry that modifies the image data to reduce or eliminate a sub-pixel layout artifact of the electronic display by modifying pixels of the image data on a sub-pixel-by-sub-pixel basis. The sub-pixel layout compensation circuitry may adjust a sub-pixel of a first color in a first pixel based at least in part on a first gradient between the sub-pixel of the first color of the first pixel and a sub-pixel of the first color of a second pixel.

20 Claims, 17 Drawing Sheets

SUB-PIXEL LAYOUT COMPENSATION

BACKGROUND

This disclosure relates to processing image data to be displayed on an electronic display and, more particularly, to adjusting the image data to reduce or eliminate an artifact due to a sub-pixel layout of the electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Many electronic devices use electronic displays, such as organic light emitting diode (OLED) displays or liquid crystal displays (LCDs), to display images. The images may be formed by programming pixels of the electronic displays to display particular colors. Each pixel may be made up of different component sub-pixels. To name a few examples, each pixel may be made up of red, green, and blue sub-pixels (RGB) or red, green, blue, and white sub-pixels (RGBW). By adjusting the brightness of the individual component sub-pixels, the pixels can be made to display a variety of different colors.

In this way, by programming the component sub-pixels of the pixels of an electronic display, images may be programmed onto the electronic display. In some cases, however, certain artifacts, such as color-fringing artifacts, may arise. These artifacts may be particularly perceptible along edges of high contrast edges of content being displayed on the electronic display. The artifacts may be more noticeable in self-emissive displays, such as OLED displays, which may have pixels having sub-pixels that are comparatively small in to the size of the pixels.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure describes systems and methods for reducing or eliminating an artifact due to sub-pixel layout in an electronic display. In particular, sub-pixel layout compensation logic, which may be implemented as hardware, software, or a combination of hardware and software, may identify gradients in image content where sub-pixel layout artifacts may arise. For instance, when a high-contrast boundary appears in image data to be displayed on an electronic display, the gradient between sub-pixels of neighboring pixels may be identified. A relatively steep gradient may suggest the potential appearance of a sub-pixel layout artifact, which may manifest as a color-fringing artifact. Thus, when a steep gradient between sub-pixels of neighboring pixels is identified, the brighter sub-pixel may be adjusted by an amount that reduces or eliminates the artifact.

In addition, the sub-pixel layout compensation logic may also take into account an amount of logic spatial frequency to avoid introducing new artifacts. Local spatial frequency refers to the amount of local variety in an area of the image data around a pixel. With greater local spatial frequency, the occurrence of a visible sup-pixel layout artifact becomes less likely. Under these conditions, attempts to modify a steep gradient between sub-pixels from neighboring pixels may introduce new artifacts. As such, the sub-pixel layout compensation logic may, in some embodiments, adjust the sub-pixel of interest to a greater degree the local spatial frequency is lower and to a lesser degree when the local spatial frequency is higher.

The amount of adjustment may also vary depending on the direction of the gradient and the color of the sub-pixel of interest that is being adjusted. Moreover, an overall brightness level of the electronic display may also be included. It may be appreciated that the sub-pixel layout compensation logic may treat the incoming image data as having an ideal gamma response, even though this may not be the case. By following the sub-pixel compensation logic with panel response compensation logic, the non-ideality of the gamma response of the image data may be addressed. In this way, the sub-pixel layout compensation logic may reduce or eliminate artifacts caused by the layouts of the sub-pixels in the electronic display while preserving the fidelity of the image content.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
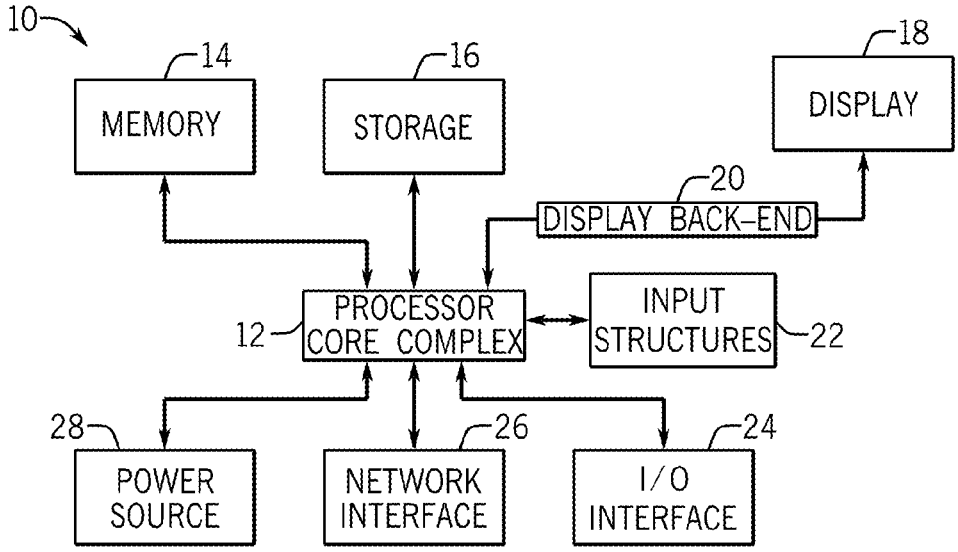
FIG. 1 is a block diagram of components that form an electronic device that may use the systems and methods of this disclosure, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

To reduce or eliminate an artifact caused by a sub-pixel layout in an electronic display, a display backend may include sub-pixel layout compensation (SPLC) logic that modifies sub-pixel values accordingly. In particular, sub-pixel layout compensation logic, which may be implemented as hardware, software, or a combination of hardware and software, may identify gradients in image content where sub-pixel layout artifacts may arise. When a high-contrast boundary appears in image data to be displayed on an electronic display, for example, the gradient between sub-pixels of neighboring pixels may be relatively steep. A relatively steep gradient may suggest the potential appearance of a sub-pixel layout artifact, which could manifest as a color-fringing artifact if the sub-pixel value is not modified. Thus, when a steep gradient between sub-pixels of neighboring pixels is identified, the brighter sub-pixel may be adjusted by an amount that reduces or eliminates the artifact.

In addition, the sub-pixel layout compensation logic may also take into account an amount of logic spatial frequency to avoid introducing new artifacts. Local spatial frequency refers to the amount of local variety in an area of the image data around a pixel. With greater local spatial frequency, the occurrence of a visible sup-pixel layout artifact becomes less likely. Under these conditions, attempts to modify a steep gradient between sub-pixels from neighboring pixels may introduce new artifacts. As such, the sub-pixel layout compensation logic may, in some embodiments, adjust the sub-pixel of interest to a greater degree the local spatial frequency is lower and to a lesser degree when the local spatial frequency is higher.

A general description of suitable electronic devices that may employ the systems and methods of this disclosure are provided. Turning first to FIG. 1, an electronic device 10 according to an embodiment of the present disclosure may include, among other things, one or more processor(s) 12, memory 14, nonvolatile storage 16, a display 18, a display backend 20, input structures 22, an input/output (e.g., I/O) interface 24, network interfaces 26, and a power source 28. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

Figure 2:
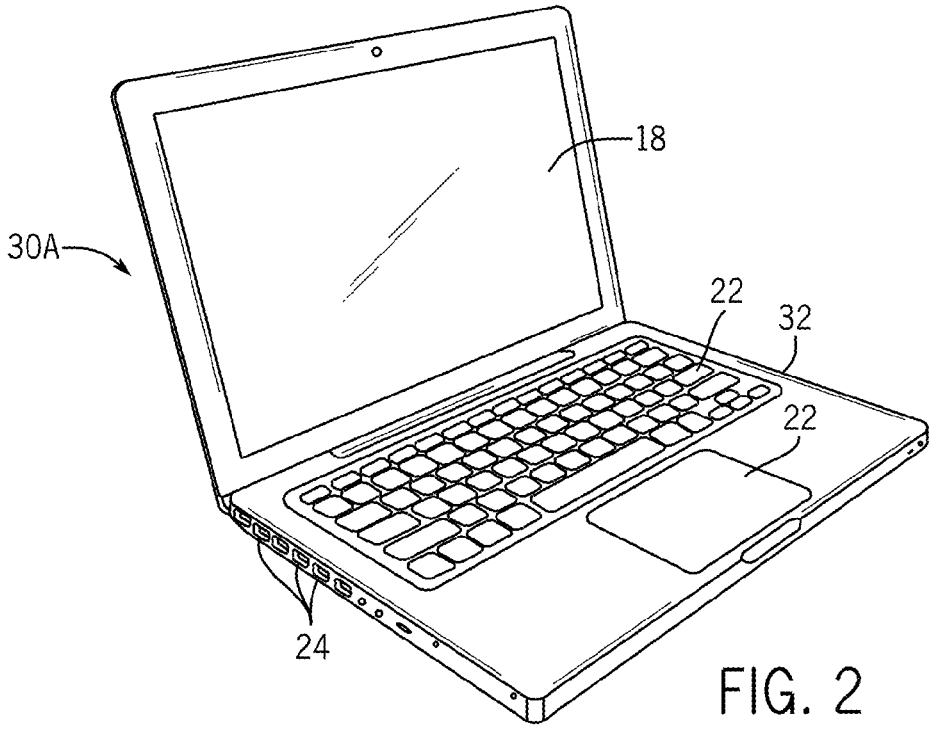
FIG. 2 is a schematic view of the electronic device in the form of a notebook computer, in accordance with an embodiment.
Figure 4:
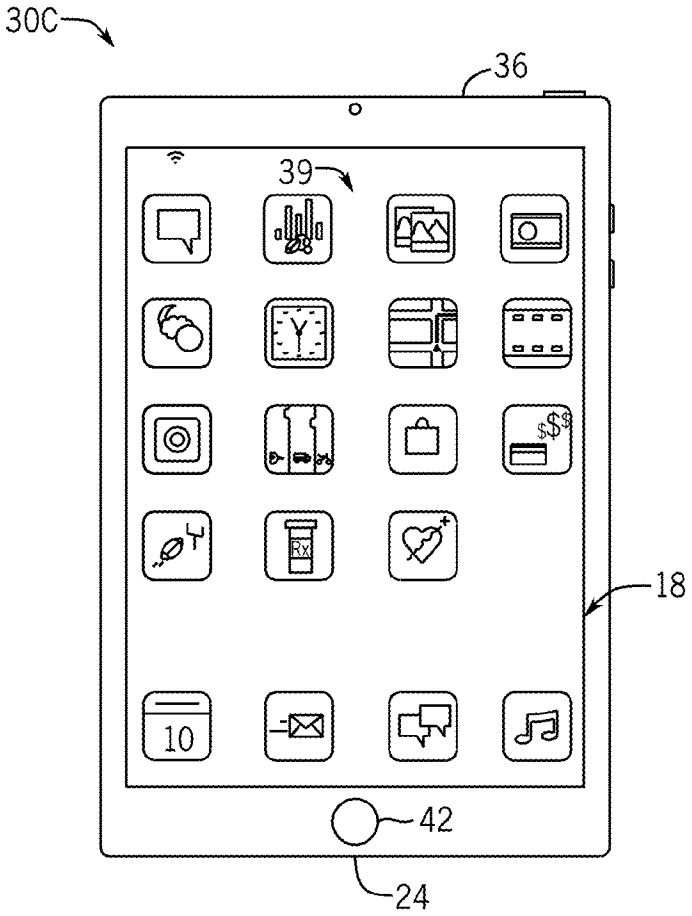
FIG. 4 is a front view of the electronic device in the form of a tablet, in accordance with an embodiment.
Figure 3:
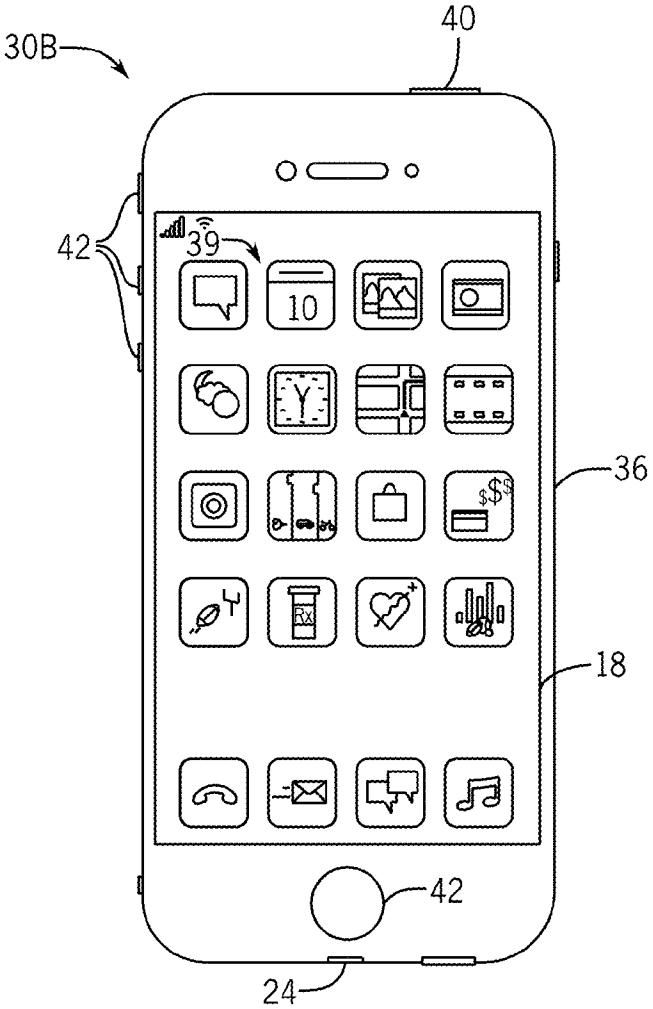
FIG. 3 is a front view of the electronic device in the form of a handheld electronic device, in accordance with an embodiment.

By way of example, the electronic device 10 may represent a block diagram of the notebook computer depicted in FIG. 2, the handheld device depicted in either of FIG. 3 or FIG. 4, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In the electronic device 10 of FIG. 1, the processor(s) 12 and/or other data processing circuitry may be operably coupled with the memory 14 and the nonvolatile memory 16 to perform various algorithms. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., e.g., an operating system) encoded on such a computer program product may also include instructions that may be executed by the processor(s) 12 to enable the electronic device 10 to provide various functionalities.

In certain embodiments, the display 18 may be a liquid crystal display (e.g., LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (e.g., OLED) displays, or some combination of LCD panels and OLED panels. The display backend 20 may process image data to prepare the image data for the electronic display 18. The display backend 20 may include sub-pixel layout compensation logic to reduce or eliminate sub-pixel layout artifacts.

The input structures 22 of the electronic device 10 may enable a user to interact with the electronic device 10 (e.g., e.g., pressing a button to increase or decrease a volume level). The I/O interface 24 may enable electronic device 10 to interface with various other electronic devices, as may the network interfaces 26. The network interfaces 26 may include, for example, interfaces for a personal area network (e.g., PAN), such as a Bluetooth network, for a local area network (e.g., LAN) or wireless local area network (e.g., WLAN), such as an 802.11x Wi-Fi network, and/or for a wide area network (e.g., WAN), such as a $3^{rd}$ generation (e.g., 3G) cellular network, $4^{th}$ generation (e.g., 4G) cellular network, or long term evolution (e.g., LTE) cellular network. The network interface 26 may also include interfaces for, for example, broadband fixed wireless access networks (e.g., WiMAX), mobile broadband Wireless networks (e.g., mobile WiMAX), and so forth. As further illustrated, the electronic device 10 may include a power source 28. The power source 28 may include any suitable source of power, such as a rechargeable lithium polymer (e.g., Li-poly) battery and/or an alternating current (e.g., AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 22, and ports of an I/O interface 24. In one embodiment, the input structures 22 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif.

The handheld device 30B may include an enclosure 36 to protect interior components from physical damage and to shield them from electromagnetic interference. The enclosure 36 may surround the display 18, which may display indicator icons 39. The indicator icons 39 may indicate, among other things, a cellular signal strength, Bluetooth connection, and/or battery life. The I/O interfaces 24 may open through the enclosure 36 and may include, for example, an I/O port for a hard wired connection for charging and/or content manipulation using a standard connector and protocol, such as the Lightning connector provided by Apple Inc., a universal service bus (USB), or other similar connector and protocol.

User input structures 42, in combination with the display 18, may allow a user to control the handheld device 30B. For example, the input structure 40 may activate or deactivate the handheld device 30B, the input structure 42 may navigate user interface to a home screen, a user-configurable application screen, and/or activate a voice-recognition feature of the handheld device 30B, the input structures 42 may provide volume control, or may toggle between vibrate and ring modes. The input structures 42 may also include a microphone may obtain a user's voice for various voice-related features, and a speaker may enable audio playback and/or certain phone capabilities. The input structures 42 may also include a headphone input may provide a connection to external speakers and/or headphones.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an iPad® available from Apple Inc. of Cupertino, Calif.

Figure 5:
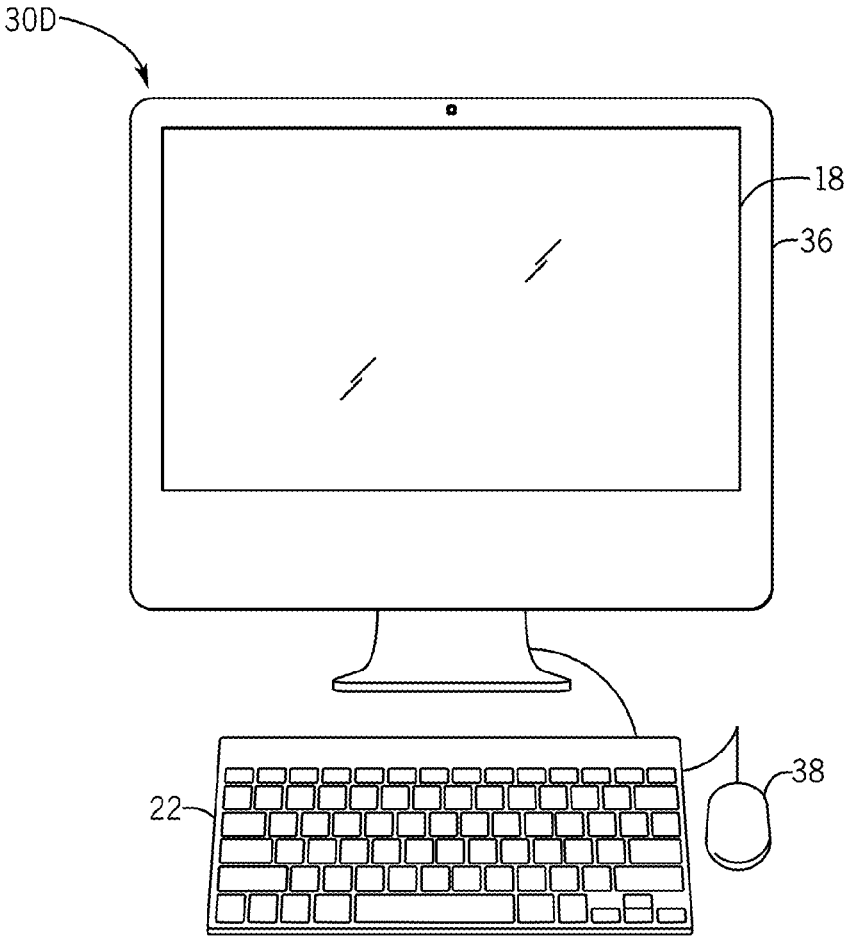
FIG. 5 is a schematic view of the electronic device in the form of a desktop computer, in accordance with an embodiment.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an iMac®, a MacBook®, or other similar device by Apple Inc. It should be noted that the computer 30D may also represent a personal computer (PC) by another manufacturer. A similar enclosure 36 may be provided to protect and enclose internal components of the computer 30D such as the display 18. In certain embodiments, a user of the computer 30D may interact with the computer 30D using various peripheral input devices, such as the input structures 22 or mouse 38, which may connect to the computer 30D via a wired and/or wireless I/O interface 24.

Figure 6:
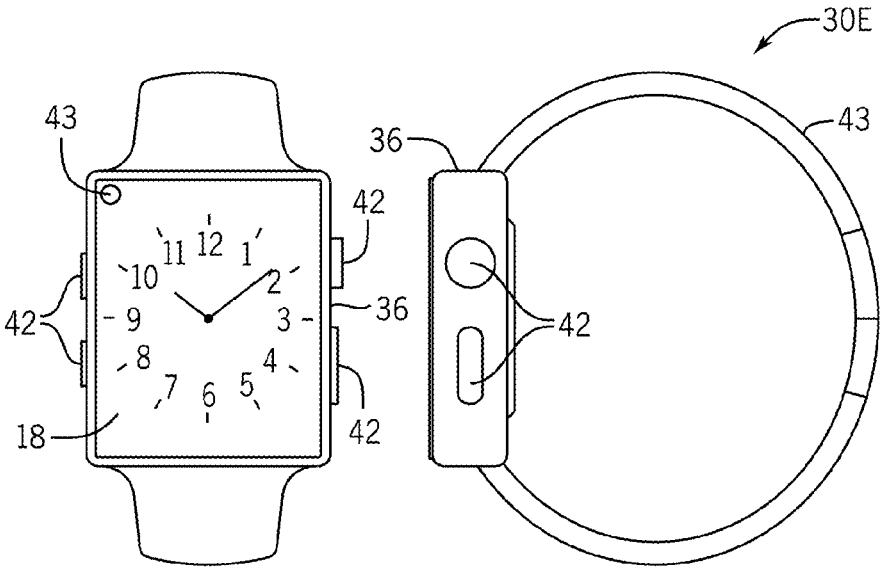
FIG. 6 includes front and side views of the electronic device in the form of a watch, in accordance with an embodiment.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an Apple Watch® by Apple, Inc. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen (e.g., LCD, OLED display, active-matrix organic light emitting diode (AMOLED) display, and so forth), which may allow users to interact with a user interface of the wearable electronic device 30E.

While the electronic devices 30A, 30B, 30C, 30D, and 30E have been shown by way of example, it should be appreciated that this is not an exhaustive list of electronic devices that may incorporate the sub-pixel layout compensation systems and methods of this disclosure. Indeed, the sub-pixel layout compensation systems and methods of this disclosure may be used by any suitable electronic devices that use an electronic display having pixels made up of subpixels.

The sub-pixel layout compensation systems and methods may be carried out in any suitable hardware, software, or combination of hardware and software. In one example, the sub-pixel layout compensation systems and methods may be carried out in the display backend 20. The display backend 20 may receive image data from the processor(s) 12, perform certain image processing to improve its appearance for display, and the output the image data to the display 18. A block diagram of the display backend 20 appears in FIG. 7. In the block diagram of FIG. 7, the incoming image data is 12-bit image data, and the output image data is 14-, 12-, or 10-, or 8-bit image data, but it should be appreciated that these bit depths are provided as one example, and are not exhaustive. The bit depths shown are meant to provide an example of bit depths that may be processed by the display backend 20. Moreover, the various functional blocks of the display backend 20 may be carried out as hardware (e.g., circuitry or application-specific integrated circuitry (ASIC)), software, and/or a combination of hardware and software.

Figure 7:
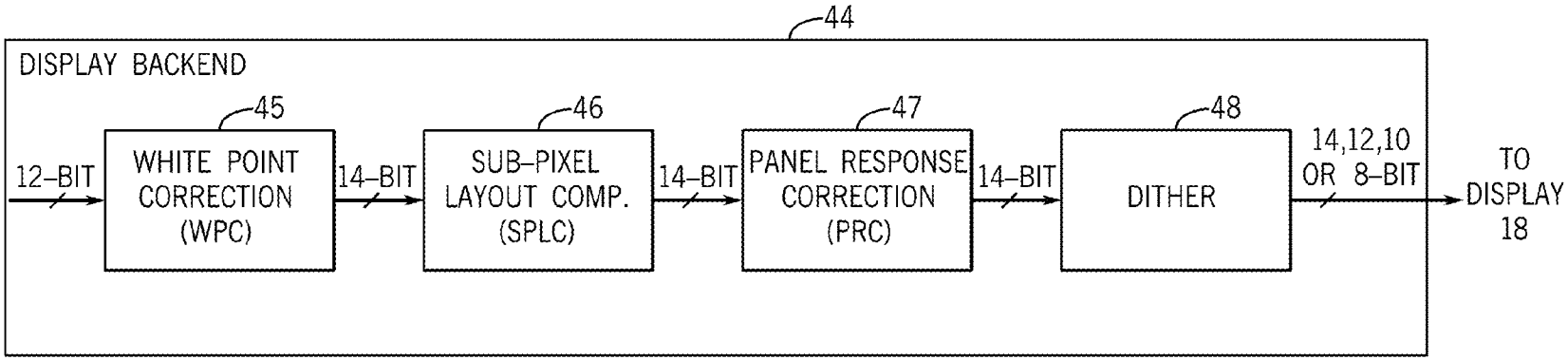
FIG. 7 is a block diagram of a display backend that includes sub-pixel layout compensation logic, in accordance with an embodiment.

In the example of FIG. 7, white point correction (WPC) logic 45 receives the image data from the processor(s) 12. The WPC logic 45 may perform an adjustment based on the temperature of the display 18 and other characteristic of the display 18 to ensure that a uniform white point, providing the image data sub-pixel layout compensation (SPLC) logic 46. As will be discussed in greater detail below, the SPLC logic 46 may adjust the image data on a sub-pixel-by-sub-pixel basis to reduce or eliminate artifacts due to the specific sub-pixel layout of the display 18. The SPLC logic 46 may occur before panel response correction (PRC) logic 47, which may adjust the image data based on specific characteristics on the display 18. This may allow the SPLC logic 46 to operate under the assumption of a display 18 having an ideal gamma response. That is, the PRC logic 47 may address the mismatch between the gamma response of the actual display 18 and the ideal gamma response assumed by the SPLC logic 46. Dithering logic 48 may receive the actual data and perform spatial, temporal, or temporospatial dithering. This may allow the image data to have a lower bit depth (e.g., 12-, 10-, or 8-bit image data), while retaining the appearance of a higher bit depth.

Figure 8:
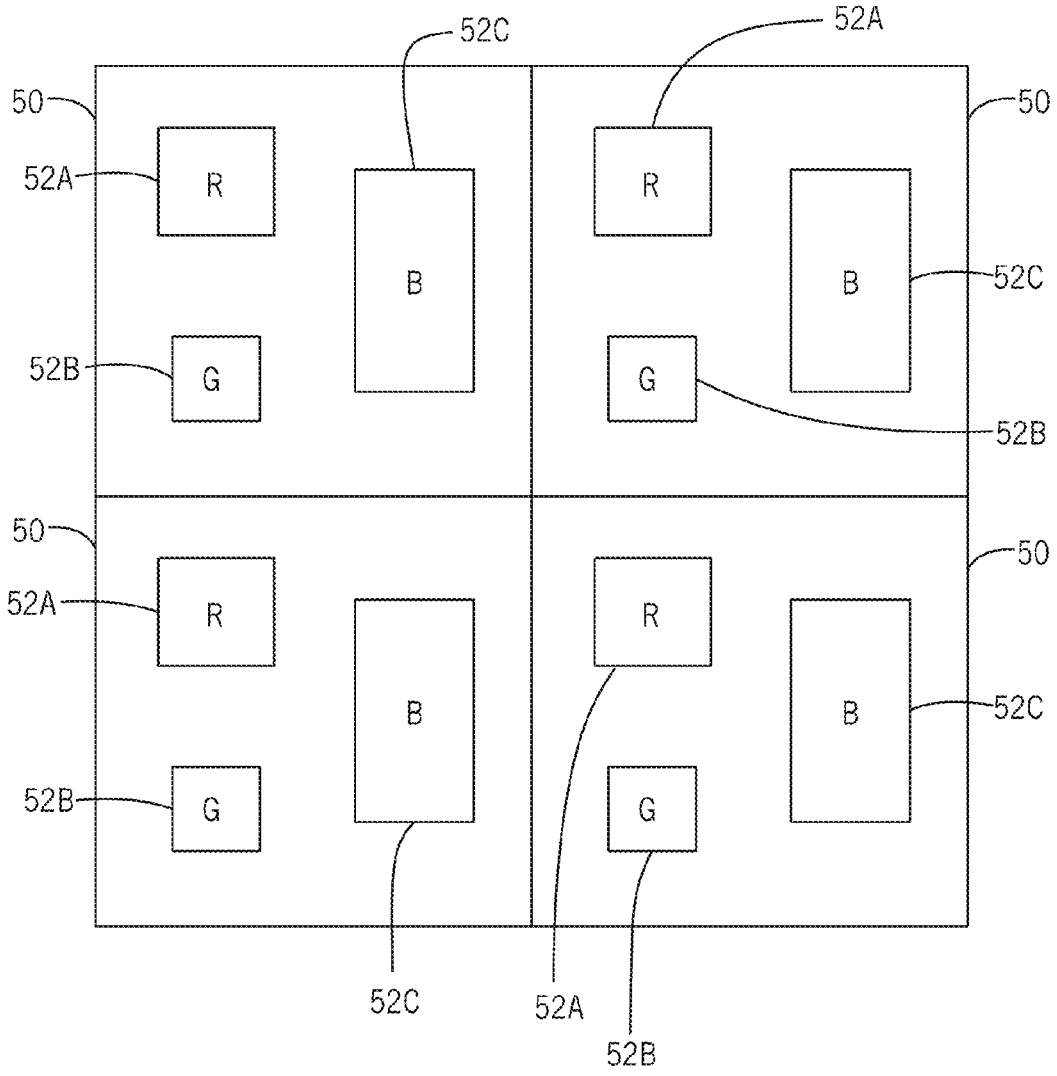
FIG. 8 is a schematic diagram showing the layout of sub-pixels within pixels of the electronic display, in accordance with an embodiment.

FIG. 8 illustrates several pixels 50 that each contains 3 sub-pixels 52A (red) 52B (green) and 52C (blue). The layout of the sub-pixels 52A, 52B, and 52C is provided schematically in FIG. 8. It should be appreciated that the size of the sub-pixels 52A, 52B, and 52C are not shown to scale. In an actual implementation, the sub-pixels 52A, 52B, and 52C may have different sizes and locations than those shown in FIG. 8. For example, the sub-pixels 52A, 52B, and 52C may occupy only a very small area of the overall pixel 50. In the particular example shown in FIG. 8, the red sub-pixel 52A is generally near the upper left-hand corner of the pixel 50, the green sub-pixel 52B is generally near the lower left-hand corner of the pixel 50, and the blue sub-pixel 52C is generally along the right-hand edge of the pixel 50. As mentioned above, other embodiments of the display 18 may have a different layout of sub-pixels 52 than shown by way of example in FIG. 8. Indeed, the description of sub-pixel layout compensation carried out by the SPLC logic 46, while described with reference to the sub-pixel layout shown in FIG. 8, should be understood to be adaptable to account for artifacts that may arise in other sub-pixel layouts.

Considering the layout of sub-pixels 52A, 52B, and 52C shown in FIG. 8, it may be appreciated that the location of the sub-pixels in relation to one another, as well as their relative sizes and therefore relative fill factors within the pixels 50, may produce a potential artifact for certain high-contrast edges occurring in image content. The human eye performs spatial integration to perceive an image. The sub-pixels 52A, 52B, and 52C may behave like point sources of light in some embodiments (e.g., may be OLED sub-pixels). As a result, as seen in FIG. 9, high-contrast edges in image content that appear on the display 18 may produce sub-pixel layout artifacts, which may be perceptible if not accounted for by the SPLC logic 46.

Figure 9:
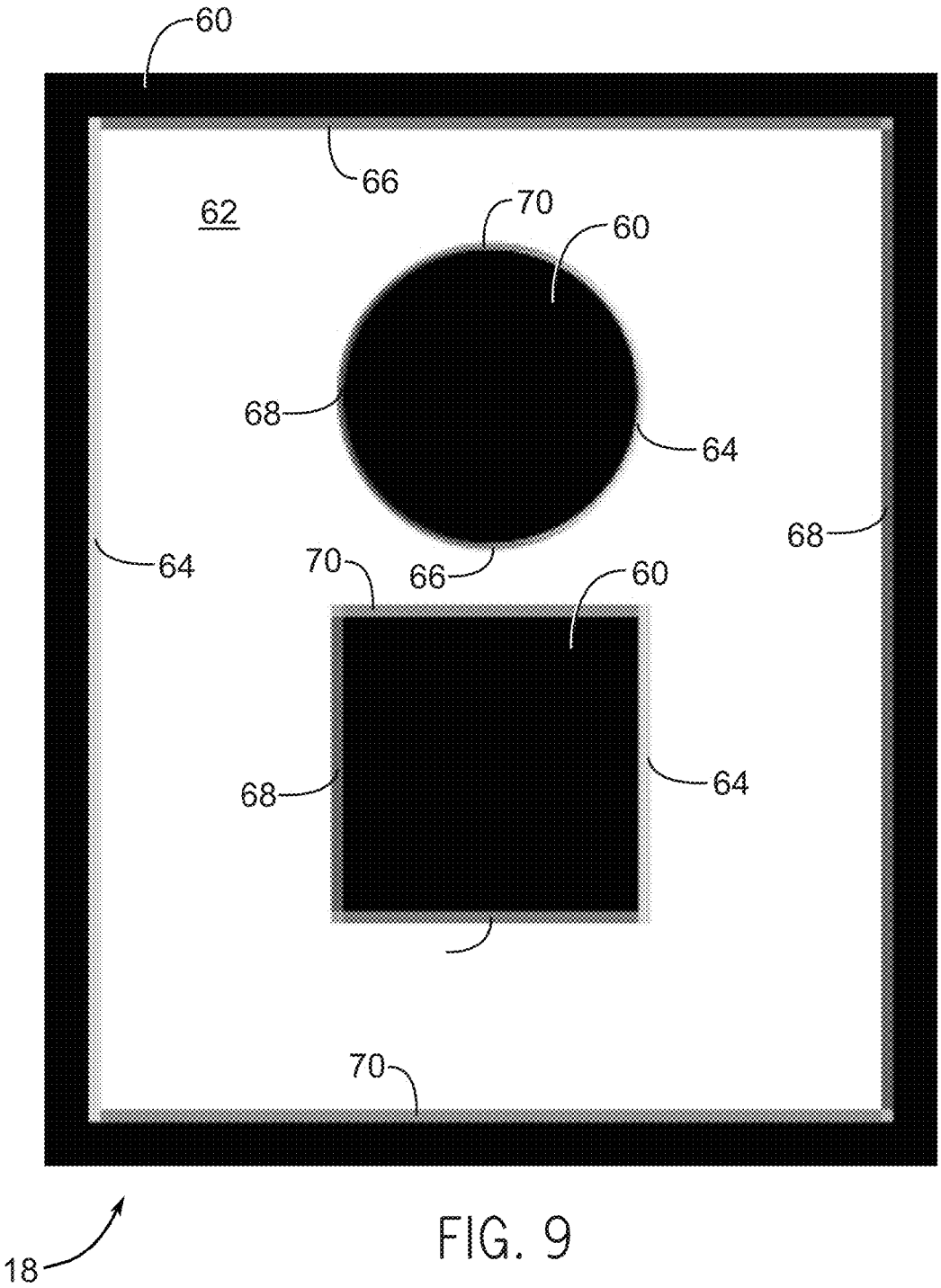
FIG. 9 is a representation of a sub-pixel layout artifact that may appear with the pixel layout of FIG. 8, in accordance with an embodiment.

In particular, in FIG. 9, the display 18 is shown to be displaying several areas of high-contrast edges. These include areas of black image content 60 and white image content 62. The black image content 60 may represent areas of the display 18 where the sub-pixels 52A, 52B, or 52C of the pixels 50 are off completely, while the white image content 62 may represent areas of the display 18 of the sub-pixels 52A, 52B, and 52C are at a maximum gray level for a particular global brightness value to produce the color white. The high-contrast edges that result between the white image content 62 and the black image content 60 may have certain sub-pixel layout artifacts. These sub-pixel layout artifacts may include yellow color fringing 64, red color fringing 66, blue color fringing 68, and green color fringing 70. These artifacts 64, 66, 68, and 70 may be due to the layout of the sub-pixels 52A, 52B, and 52C shown in FIG. 8.

Figure 10:
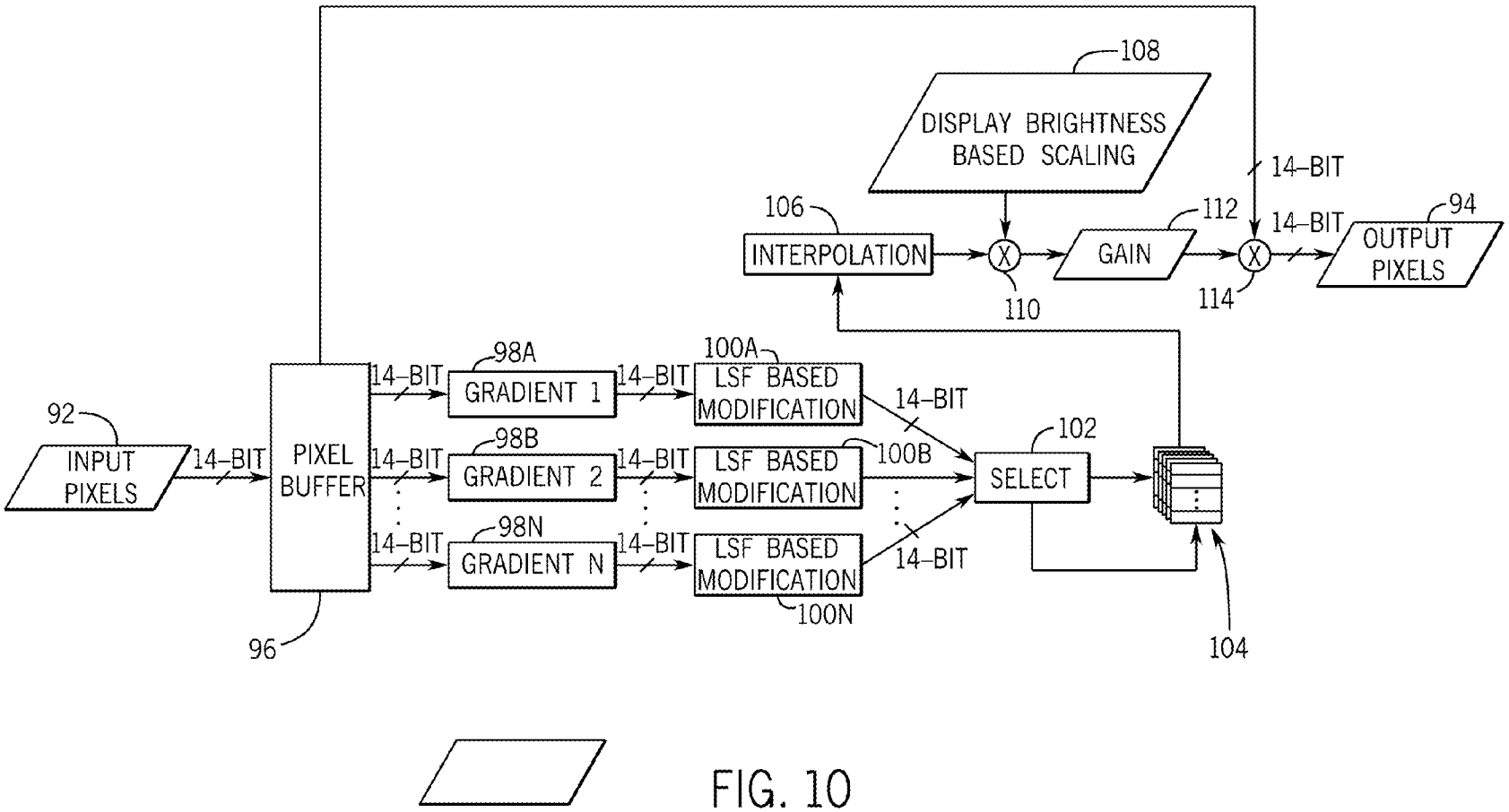
FIG. 10 is a block diagram of the sub-pixel layout compensation logic, in accordance with an embodiment.

The sub-pixel layout consumption (SPLC) logic 46 may process the image data to reduce or eliminate such artifacts. A schematic block diagram of the SPLC logic 46 is shown in FIG. 10. The SPLC logic 46 receives input pixels 92 (e.g., from the WPC logic 45) and outputs adjusted output pixels 94 (e.g., to the PRC logic 47). The input pixels 92 enter a pixel buffer 96 that may store some number of lines of the image data that is to be displayed on the display 18. As will be described below, in one embodiment, the pixel buffer 96 may hold 6 lines of image data.

As discussed above with reference to FIG. 9, the sub-pixel layout artifacts (e.g., 64, 66, 68, and 70) tend to appear where steep gradients in gray levels occur between sub-pixels 52A, 52B, or 52C of neighboring pixels 50. Moreover, the visibility of the sub-pixel layout artifacts (e.g., 64, 66, 68, and 70) may also depend on the spatial frequency—that is, the amount of local variation in gray levels of same-colored pixels 52. As such, the SPLC logic 46 may calculate several gradients and a corresponding local spatial frequency indicator relating to that gradient. For example, the SPLC logic 46 may calculate a total of N gradients using gradient calculation logic 98A, 98B, . . . 98N, the results of which may be provided to local-spatial-frequency-(LSF-) based modification logic 100A, 100B, . . . 100N. The LSF-based modification logic 100A, 100B, . . . 100N may modify the gradients calculated by the gradient calculation logic 98A, 98B, . . . 98N depending on the amount of local spatial frequency. The greater the local spatial frequency, the more the gradients may be modified in a way that reduces the amount of ultimate sub-pixel adjustment. Selection logic 102 may receive the resulting values and select one of these per color sub-pixel 52 (e.g., one gradient for red, one for green, and one for blue) to index certain corresponding lookup tables (LUTs) from among several LUTs 104. Linear interpolation logic 106 may linearly interpret between two entries of the selected lookup tables 104 to produce sub-pixel modification values. In combination with a display brightness-based scaling factor 104, the results of the interpolation logic 106 may be multiplied 110 to produce a gain 112. The gain 112 may be multiplied 114 with the current pixel 50 to may adjust the sub-pixels 52 of the current pixel 50, producing an output pixel 50.

Figure 11:
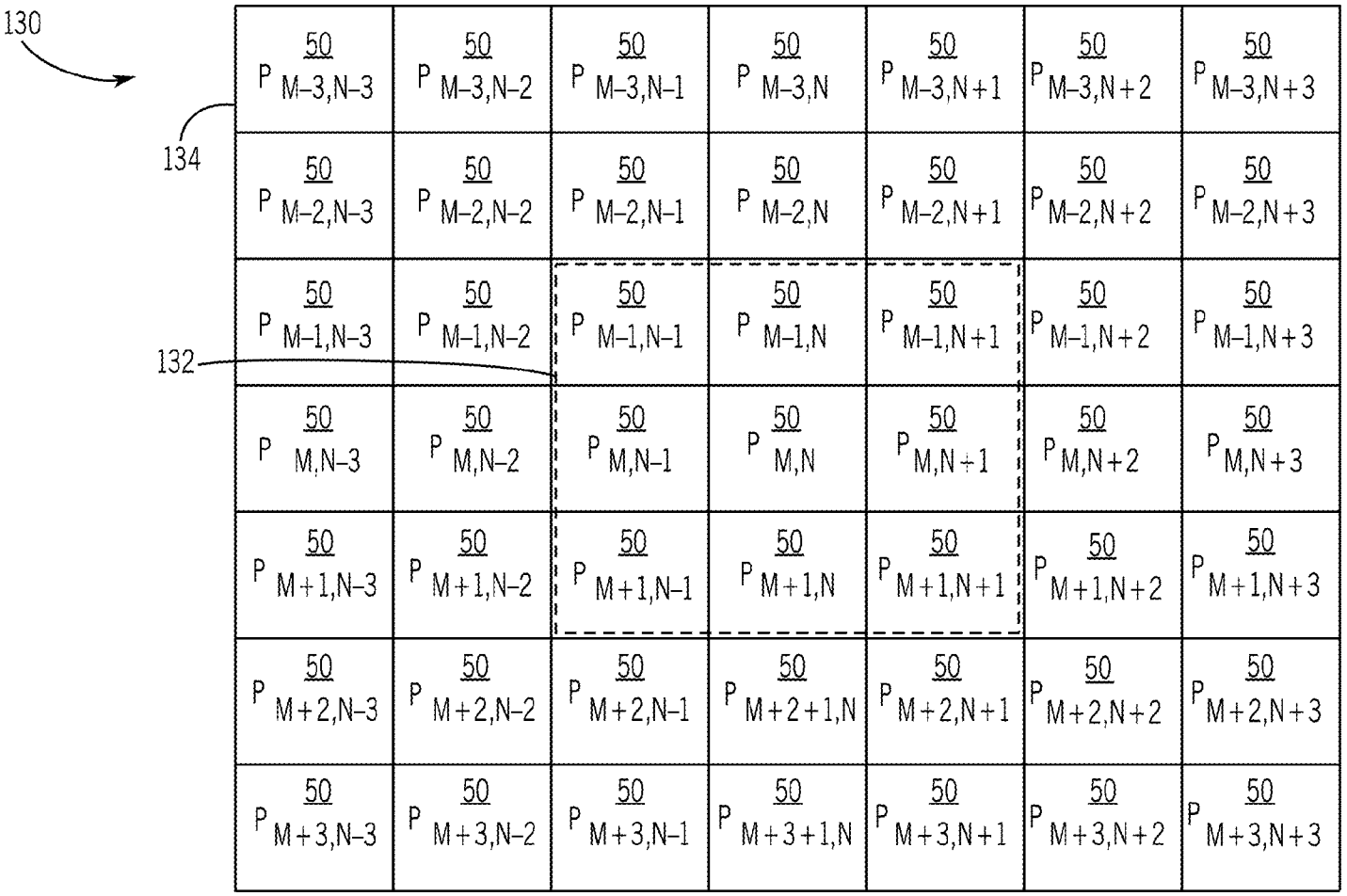
FIG. 11 is a diagram of a neighborhood of pixels surrounding a pixel of interest to be processed by the sub-pixel layout compensation logic, in accordance with an embodiment.

Before continuing, FIG. 11 provides an illustration of a descriptive convention that will be used to describe the processing of the sub-pixels 52 in the SPLC logic 46. FIG. 11 illustrates a neighborhood of pixels 130 that surrounds a current pixel $P_{M,N}$, where the current pixel is the pixel 50 that is currently being adjusted in the SPLC 46. Although not visible in the example of FIG. 11, each pixel 50 includes respective sub-pixels 52A, 52B, and 52C in the sub-pixel layout of FIG. 9. A local neighborhood 132 includes the nearest 8 pixels that surround the current pixel 50. A larger pixel neighborhood 134 includes pixels from line M−3 to line M+3, and columns N−3 to column N+3. It should be appreciated that the pixel buffer 96 may include any suitable number of lines of pixels, and may, in some embodiments, include all of the pixels 50 shown in the pixel neighborhood 130. In some embodiments, however, the pixel buffer 96 may include fewer lines of pixels. For example, the pixel buffer 96 may hold lines M−3 to line M+2, or line M−2 to line M+3. The SPLC logic 46 may use the image data stored in the pixels 50.

The naming convention shown in FIG. 11 will be used below in relation to the sub-pixels 52A, 52B, and 52C in describing the operation of the gradient calculation logic 98A, 98B, . . . 98N and the LSF-based modification logic 100A, 100B, . . . 100N. For example, each pixel 50 may be understood to include component sub-pixels 52A, 52B, and 52C with similar notations. Thus, the current pixel 50 $P_{M,N}$ is composed of 3 sub-pixels 52A, 52B, and 52C (e.g., as shown in FIG. 9), which may be denoted as $R_{M,N}$, $G_{M,N}$, and $B_{M,N}$, respectively.

Gradient Calculation

Figure 12:
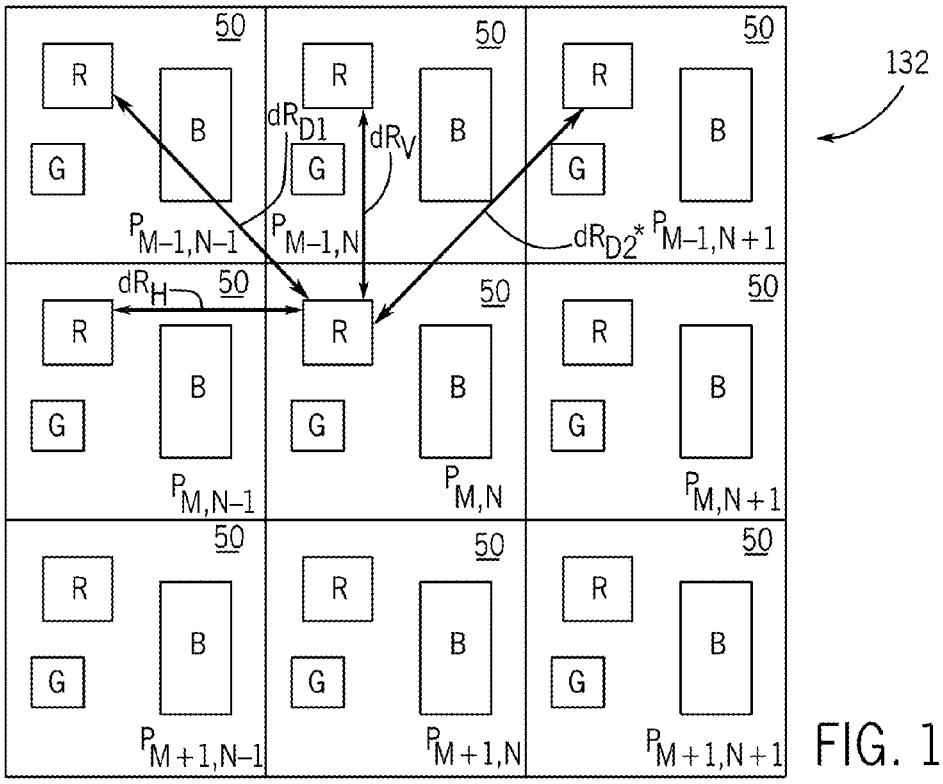
FIG. 12 is a diagram showing gradients that may be calculated for a red sub-pixel in the sub-pixel layout of FIG. 10, in accordance with an embodiment.
Figure 13:
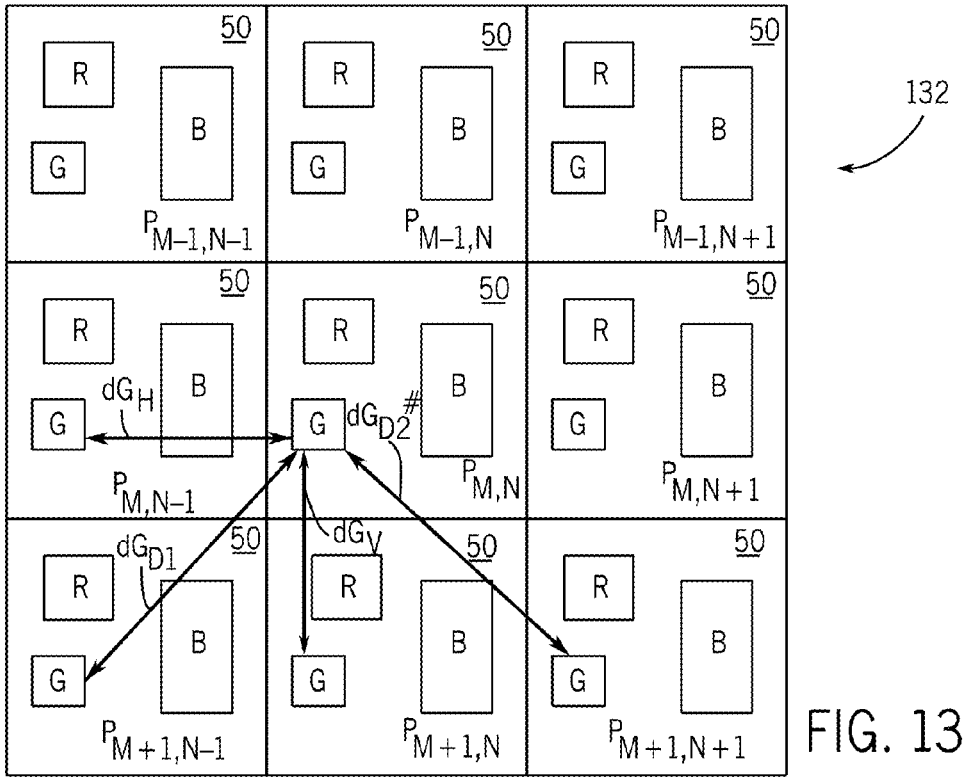
FIG. 13 is a diagram showing gradients that may be calculated for a green sub-pixel in the sub-pixel layout of FIG. 10, in accordance with an embodiment.
Figure 14:
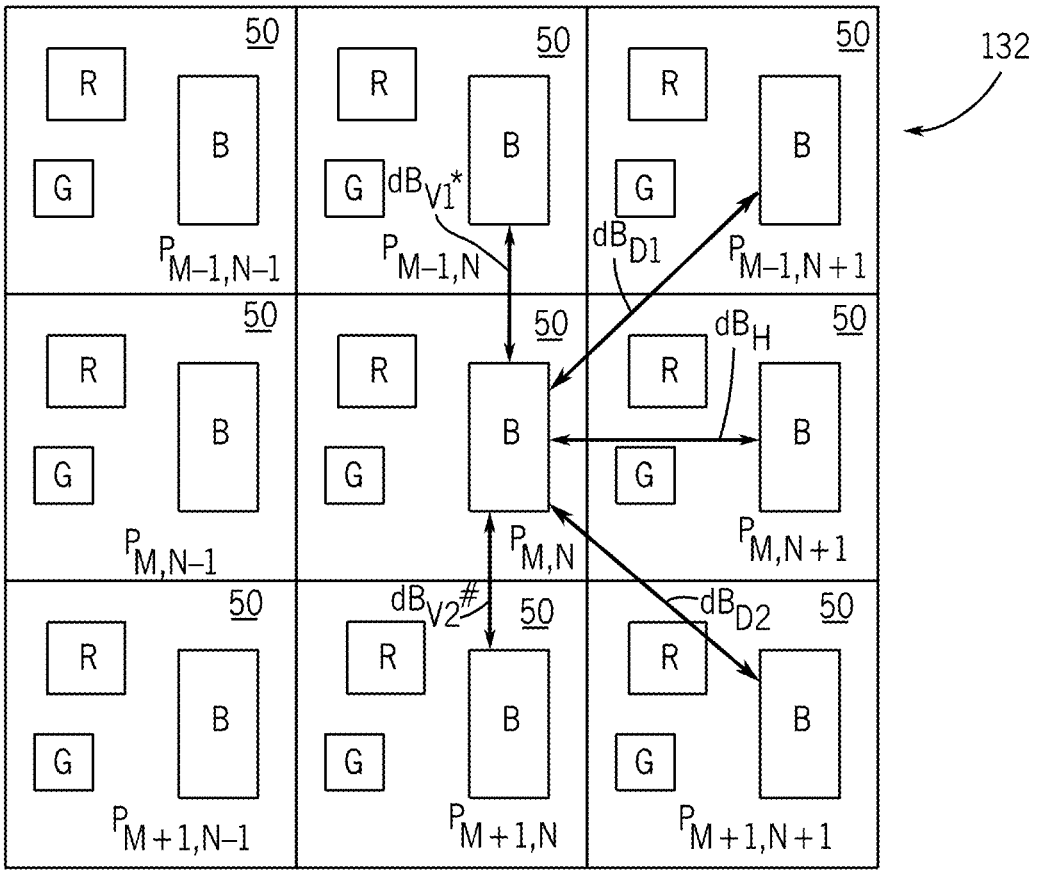
FIG. 14 is a diagram showing gradients that may be calculated for a blue sub-pixel in the sub-pixel layout of FIG. 10, in accordance with an embodiment.

The gradient calculation logic 98A, 98B, . . . 98N may perform gradient calculations independently for each sub-pixel 52A, 52B, and 52C, of the current pixel 50 ($P_{M,N}$). As illustrated by FIGS. 12-14, the gradient calculations may take place based on pixels within a 3×3 neighborhood around the current pixel 50. It may be appreciated that, for pixel locations that fall outside the boundary of pixel display 18, any suitable out-of-boundary values may be programmed and may be used as the neighboring pixel values for the compensation technique. For example, the out-of-boundary values may be the color of the bezel of the display, may be black, may be white, or may be the average value of the content of the display or some local window. Moreover, as discussed above with reference to FIG. 10, the input and output sub-pixel 52A, 52B, and 52C values may have any suitable precision. In one example, the precision may be 14-bit precision (e.g., represented as unsigned 14-bit, or u0.14).

In one example, the SPLC logic 46 may calculate 11 different gradients: 3 separate gradients for each respective red sub-pixel 52A, green sub-pixel 52B, and blue sub-pixel 52C, plus 2 gradients that are configurable to operate on either the blue sub-pixel 52C or one of the red or green sub-pixels 52A or 52B. The gradients may be calculated with any suitable precision. In one example, when the input pixels are 14-bit precision, the gradient may be signed 14-bit values (e.g., s0.14).

FIG. 12 shows the neighborhood of pixels 132 when gradients relating to the red sub-pixels 52A are calculated. These include a vertical gradient $dR_V$, a horizontal $dR_H$, a diagonal gradient $dR_{D1}$, and/or a selectable second diagonal gradient $dR_{D2}$*. As will be discussed below, the gradient $dR_{D2}$* represents a configurable gradient that may or not be calculated in place of a blue-sub-pixel gradient $dB_{V1}$*, which is described with reference to FIG. 14 below.

Computations for the red sub-pixel 52A are provided below:

$$dR_V=R_{M,N}-R_{M-1,N}$$

$$dR_H=R_{M,N}-R_{M,N-1}$$

$$dR_{D1}=R_{M,N}-R_{M-1,N-1}$$

$$dR_{D2}^*=R_{M,N}-R_{M-1,N+1}$$

FIG. 13 shows the neighborhood of pixels 132 in relation to gradients that may be calculated for the green sub-pixel 52B. These may include a vertical gradient $dG_V$, a horizontal gradient $dG_H$, a first diagonal gradient $dG_{D1}$, and/or a configurable second diagonal gradient $dG_{D2}^{\#}$. The gradient $dG_{D2}^{\#}$ represents a configurable gradient that may or may not be calculated depending on whether a blue-pixel gradient $dB_{D2}^{\#}$ is calculated, which will be described in greater detail below with reference to FIG. 14. Computations for the green sub-pixel 52B are provided below:

$$dG_V=G_{M,N}-G_{M+1,N}$$

$$dG_H=G_{M,N}-G_{M,N-1}$$

$$dG_{D1}=G_{M,N}-G_{M+1,N-1}$$

$$dG_{D2}\#=G_{M,N}-G_{M+1,N+1}$$

FIG. 14 illustrates the neighborhood of pixels 132 in relation to gradients that may be calculated for the blue sub-pixel 52C. The gradients calculated for the blue sub-pixel 52C may include a horizontal gradient $dB_H$, a configurable first vertical gradient $dB_{D1}$* a configurable second vertical gradient $DB_{D2}^{\#}$, a first diagonal gradient $dB_{D1}$, and/or a second diagonal gradient $dV_{D2}$. It should be appreciated that the two vertical gradients $DB_{D1}$* and $DB_{D2}^{\#}$ may or may not be calculated depending on whether other gradients for the red sub-pixel 52A ($dR_{D2}$*) and the green sub-pixel 52B ($dG_{D2}^{\#}$) have been selected instead. Computations for the blue sub-pixel 52B are provided below:

$$dB_H=B_{M,N}-B_{M,N+1}$$

$$dB_{V1}^*=B_{M,N}-B_{M-1,N}$$

$$dB_{V2}\#=B_{M,N}-B_{M+1,N}$$

$$dB_{D1}=B_{M,N}-B_{M-1,N+1}$$

$$dB_{D2}=B_{M,N}-B_{M+1,N+1}$$

As should be appreciated from FIGS. 12-14, the gradients calculated for the red sub-pixel 52A, green sub-pixel 52B, and blue sub-pixel 52C are computed in relation to sub-pixels of the same color in these neighboring pixels in the pixel neighborhood 132. The particular gradients that are computed are those in relation to neighboring pixels that are close to the edge of the pixel 50 where the particular sub-pixel 52 is located. That is, since, in the particular sub-pixel layout provided by way of example in this disclosure, the red sub-pixel 52A is in the upper left hand corner of the pixel 50, the gradients calculated for the red sub-pixel 52A are gradients for those neighboring pixels. The configurable gradients are those that may be less likely to identify a sub-pixel layout artifact. For example, the gradient $dR_{D2}$*, which is the gradient between the sub-pixel 52A of the pixel 50 and the corresponding sub-pixel 52A of the upper-right-hand neighboring pixel 50 may be less likely to provide information that could correct a potential sub-pixel layout artifact, since the red sub-pixel 52A is closer to other pixels 50 than the upper-right-hand neighboring pixel 50. This logic applies for the other configurable gradients, as well. It should further be appreciated that, for different sub-pixel 52 layouts, different gradients may be calculated.

Returning to FIG. 10, it may be seen that the output of the gradient calculation logic 98A, 98B, . . . 98N may be provided to respective LSF-based modification logic 100A, 100B, . . . 100N. If any of the calculated gradients is negative, however, no more calculations may take place in relation to those gradients. In other words, for each sub-pixel 52A, 52B, and 52C, any gradient value that is negative would not represent a gradient where a sub-pixel layout artifact would be likely to occur. As such, a corresponding LSF-based modification factor may also not be calculated. Indeed, in the case that all of the gradients for a particular sub-pixels 52A, 52B, or 52C are negative, no other computations may be carried out for that sub-pixel 52A, 52B, or 52C, and the sub-pixel 52A, 52B, or 52C may pass through the SPLC logic 46 unmodified. Even so, as will be discussed below, negative gradient values may be stored and used in computing the LSF-based modification factor, since local spatial frequency may be determined using absolute values of differences between pixels.

Local Spatial Frequency (LSF) Based Modification

As may be appreciated, even though a gradient may be relatively steep between a sub-pixel 52 of a current pixel 50 and a neighboring sub-pixel 52 of a neighboring pixel 50, the visibility of any resulting sub-pixel layout artifacts may drop as complexity in the local texture of the image displayed on the image display 18 increases. In fact, performing the same degree of correction under those conditions could create new artifacts. As such, the local spatial frequency (LSF) based modification logic 100A, 100B, . . . 100N of the SPLC logic 46 may apply a correction to the computed gradients based on the local spatial frequency (LSF) of content within some window of pixels along the same direction as the gradient that is being modified.

Figure 15:
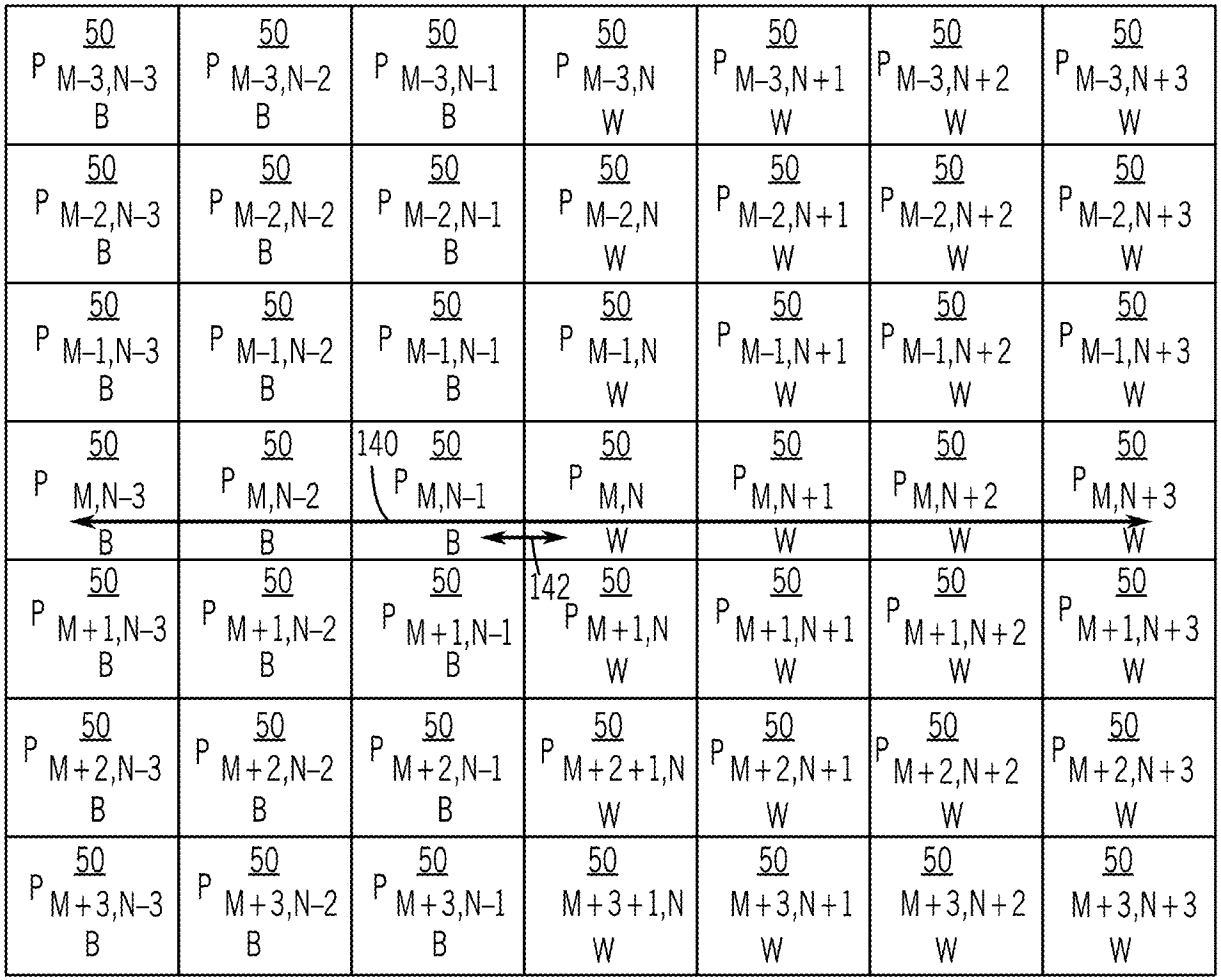
FIG. 15 is a diagram showing an example where a steep gradient and low local spatial frequency (LSF) occur along the gradient, indicating a high degree of compensation is warranted, in accordance with an embodiment.

For example, FIG. 15 shows an example where a local window 140 around a current pixel 50 ($P_{M,N}$) exhibits relatively low spatial frequency despite a relatively high gradient 142. In the example of FIG. 15, the current pixel 50 ($P_{M,N}$) is a white pixel (e.g., all of the sub-pixels 52A, 52B, and 52C have gray levels of 255 in an 8-bit scale). The current pixel 50 ($P_{M,N}$) is along an edge between black and white image content. As such, the relatively steep gradient 142 between the current pixel 50 ($P_{M,N}$) may produce a relatively strong sub-pixel layout artifact for the red sub-pixel 52A and the green sub-pixel 52B when the pixel 50 has the sub-pixel layout shown in FIG. 8.

Figure 16:
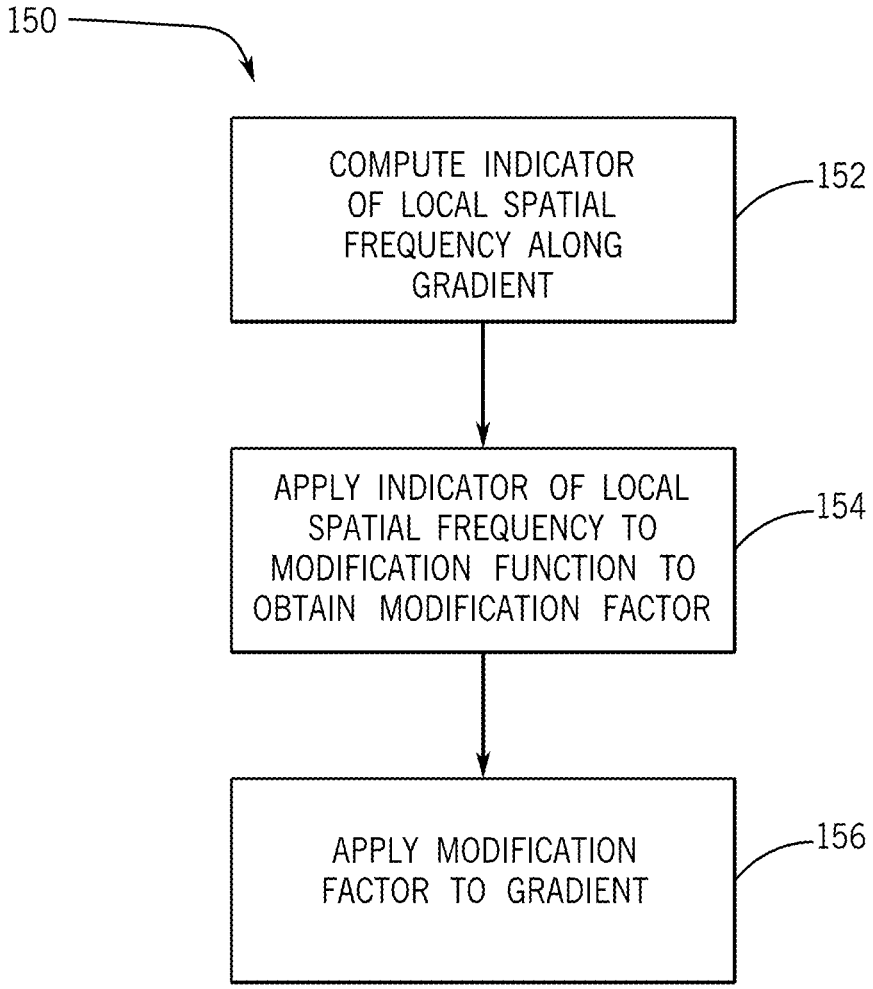
FIG. 16 is a flowchart of a method for determining and using a local spatial frequency to affect the amount of compensation provided by the sub-pixel layout compensation logic, in accordance with an embodiment.

The LSF-based modification logic 100A, 100B, . . . 100N may respectively operate as shown by a flowchart 150 of FIG. 16. Namely, the LSF-based modification logic 100A, 100B, . . . 100N may compute some indicator of local spatial frequency along the same direction as the gradient that is being modified (block 152). The LSF-based modification logic 100A, 100B, . . . 100N may apply the indicator calculated at block 152 into a modification function to obtain a gradient modification factor (block 154). The modification factor may be applied to the value of the gradient that is to be modified (e.g., multiplied) to obtain a modified gradient depending upon that now reflects the amount of local spatial frequency in the local content (block 156).

Figure 17:
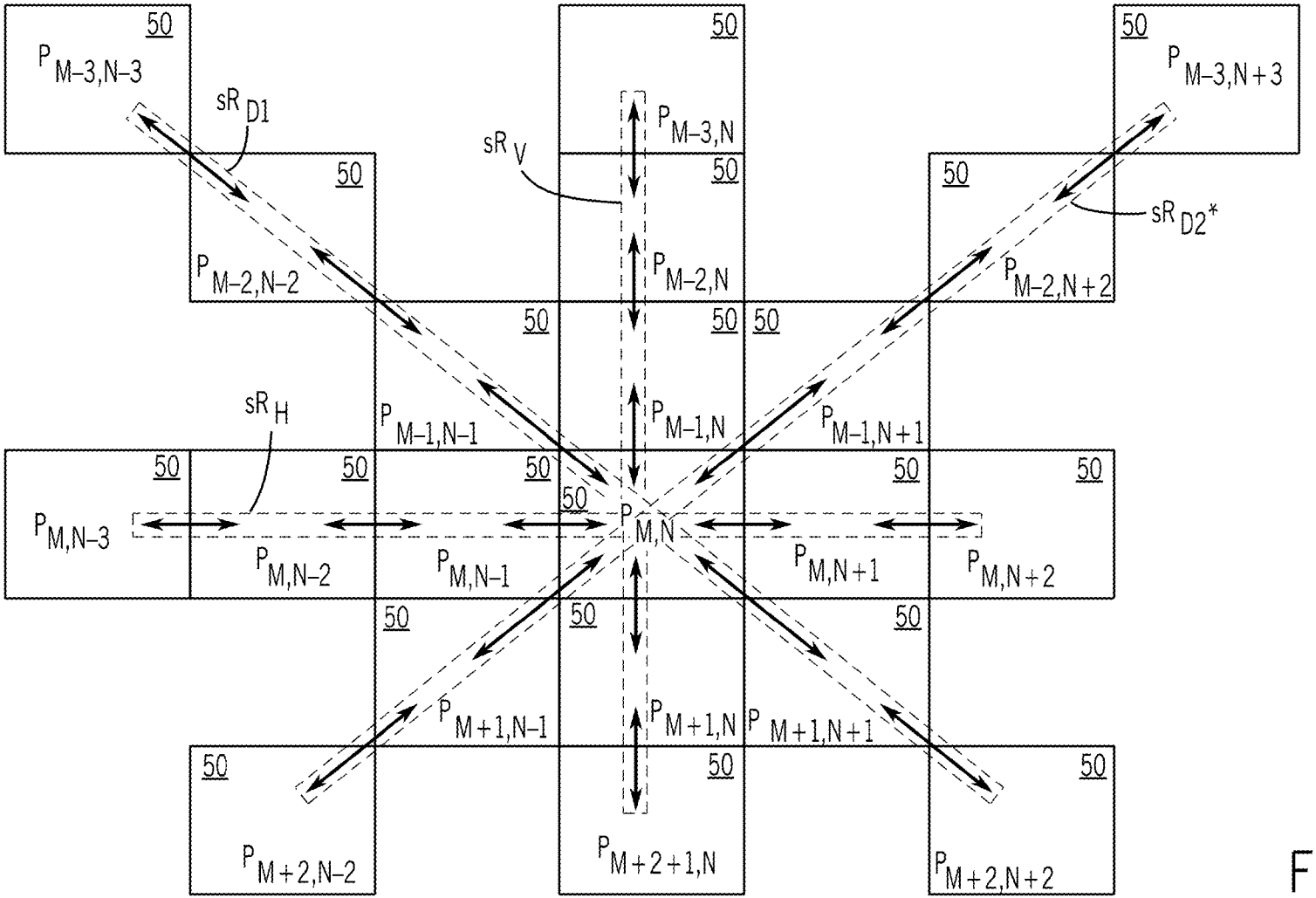
FIG. 17 is a diagram showing local spatial frequency (LSF) indicators that may be calculated for a red sub-pixel in the sub-pixel layout of FIG. 10, in accordance with an embodiment.
Figure 18:
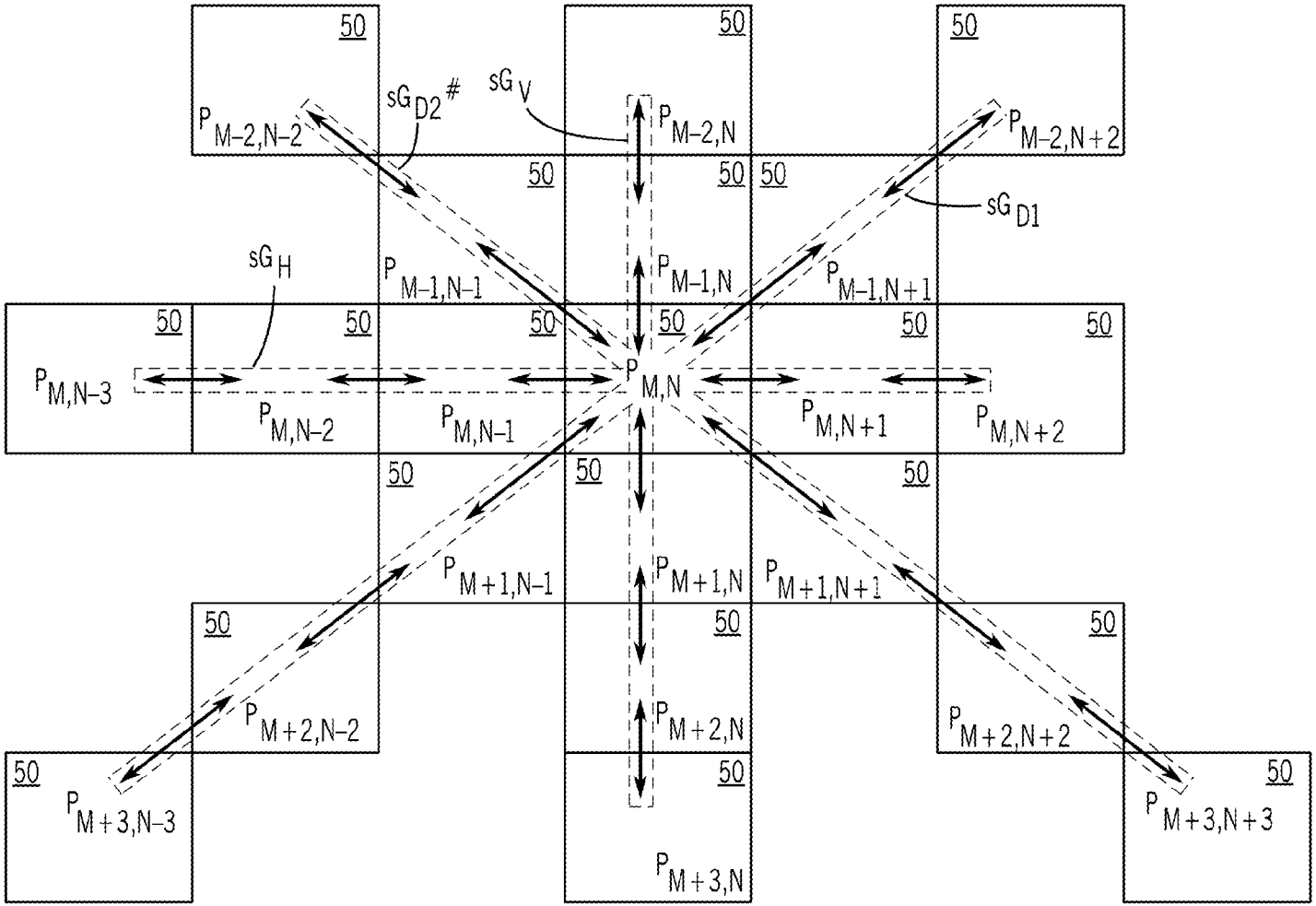
FIG. 18 is a diagram showing local spatial frequency (LSF) indicators that may be calculated for a green sub-pixel in the sub-pixel layout of FIG. 10, in accordance with an embodiment.
Figure 19:
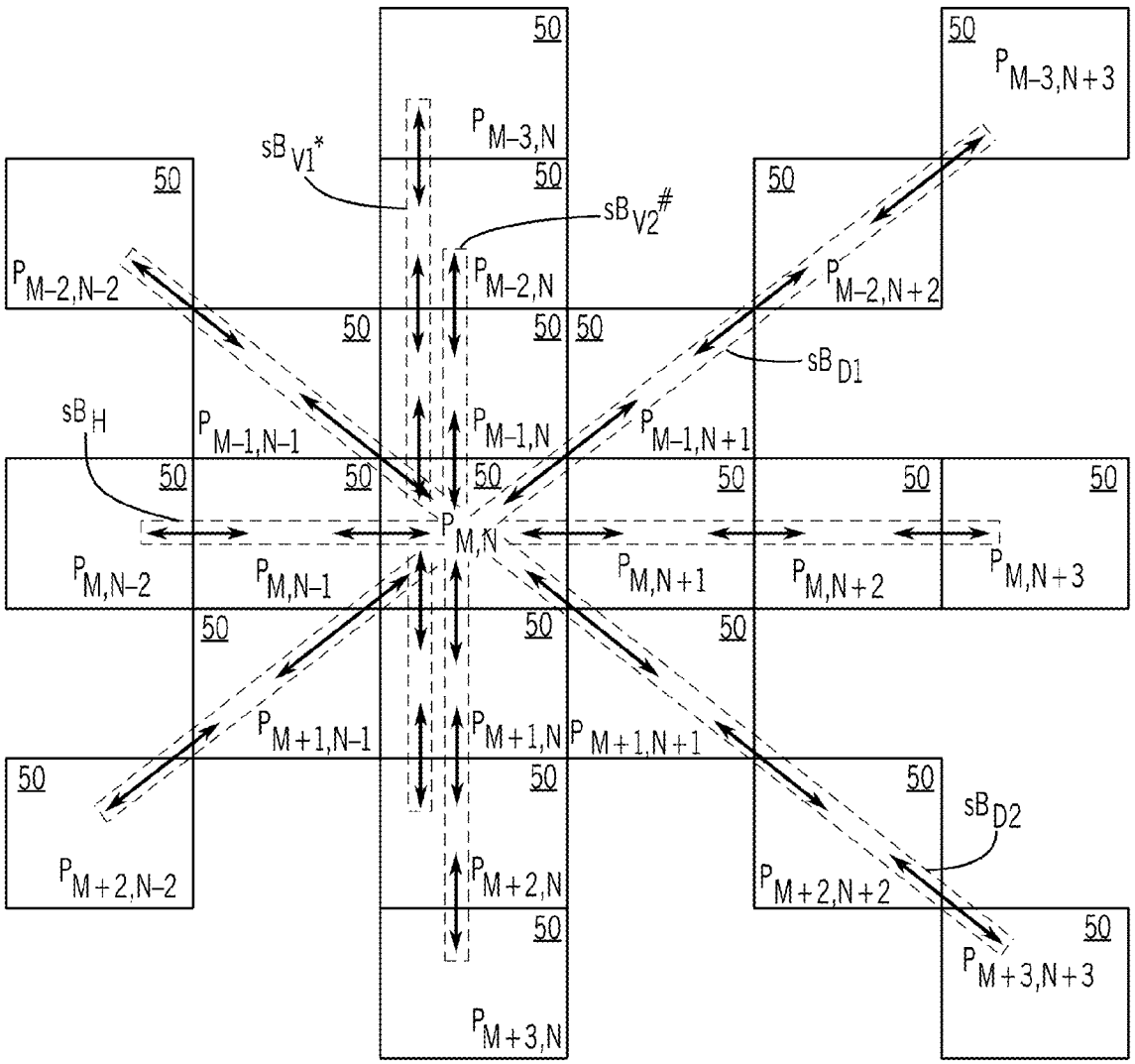
FIG. 19 is a diagram showing local spatial frequency (LSF) indicators that may be calculated for a blue sub-pixel in the sub-pixel layout of FIG. 10, in accordance with an embodiment.

FIGS. 17, 18, and 19 are block diagrams that describe local spatial frequency computations that may be determined for modifying the gradient values determined by the gradient computation logic 98A, 98B, . . . 98N. Although the sub-pixels 52A, 52B, and 52C do not appear in these figures to avoid clutter, it should be understood that all of the pixels 50 shown in FIGS. 17, 18, and 19 include respective sub-pixels 52A, 52B, and 52C. For example, each pixel 50 may include the sub-pixels 52A, 52B, and 52C in the layout shown in FIG. 9.

FIG. 17 shows a local spatial frequency (LSF) computation along the gradients for a red sub-pixel of the current pixel 50 ($P_{M,N}$). These may include a vertical local spatial frequency computation $sR_V$, a horizontal local spatial frequency computation $sR_H$, a first diagonal local spatial frequency computation $sR_{D1}$, and/or a second diagonal local spatial frequency computation $sR_{D2}$*:

$$sR_V=|R_{M-2,N}-R_{M-3,N}|+|R_{M-1,N}-R_{M-2,N}|+|R_{M,N}-R_{M-1,N}|+|R_{M+1,N}-R_{M,N}|+|R_{M+2,N}-R_{M+1,N}|$$

$$sR_H=|R_{M,N-2}-R_{M,N-3}|+|R_{M,N-1}-R_{M,N-2}|+|R_{M,N}-R_{M,N-1}|+|R_{M,N+1}-R_{M,N}|+|R_{M,N+2}-R_{M,N+1}|$$

$$sR_{D1}=|R_{M-2,N-2}-R_{M-3,N-3}|+|R_{M-1,N-1}-R_{M-2,N-2}|+|R_{M,N}-R_{M-1,N-1}|+|R_{M+1,N+1}-R_{M,N}|+|R_{M+2,N+2}-R_{M+1,N+1}|$$

$$sR_{D2}^{*}=|R_{M-2,N+2}-R_{M-3,N+3}|+|R_{M-1,N+1}-R_{M-2,N+2}|+|R_{M,N}-R_{M-1,N+1}|+|R_{M+1,N-1}-R_{M,N}|+|R_{M+2,N-2}-R_{M+1,N-1}|$$

FIG. 18 shows a local spatial frequency (LSF) computation along the gradients for a green sub-pixel of the current pixel 50 ($G_{M,N}$). These may include a vertical local spatial frequency computation $sG_V$, a horizontal local spatial frequency computation $sG_H$, a first diagonal local spatial frequency computation $sG_H$, and/or a second diagonal local spatial frequency computation $sG_{D2}^{\#}$:

$$sG_V=|G_{M-2,N}-G_{M-1,N}|+|+|G_{M-1,N}-G_{M,N}|+|G_{M,N}-G_{M+1,N}|+|G_{M+1,N}-G_{M+2N}|+|G_{M+2,N}-G_{M+3,N}|$$

$$sG_H=|G_{M,N-2}-G_{M,N-3}|+|G_{M,N-1}-G_{M,N-2}|+|G_{M,N}-G_{M,N-1}|+|G_{M,N+1}-G_{M,N}|+|G_{M,N+2}-G_{M,N+1}|$$

$$sG_{D1}=|G_{M-2,N+2}-G_{M-1,N+1}|+|G_{M-1,N+1}-G_{M,N}|+|G_{M,N}-G_{M+1,N-1}|+|G_{M+1,N-1}-G_{M+2,N-2}|+|G_{M+2,N-2}-G_{M+3,N-3}|$$

$$sG_{D2}^{\#}=|G_{M-2,N-2}-G_{M-1,N-1}|+|G_{M-1,N-1}-G_{M,N}|+|G_{M,N}-G_{M+1,N+1}|+|G_{M+1,N+1}-G_{M+2,N+2}|+|G_{M+2,N+2}-G_{M+3,N+3}|$$

FIG. 19 shows a local spatial frequency (LSF) computation along the gradients for a blue sub-pixel of the current pixel 50 ($B_{M,N}$). These may include a horizontal local spatial frequency computation $sB_H$, a first vertical local spatial frequency computation $sB_{V1}$*, a second vertical local spatial frequency computation $sB_{V2}^{\#}$, a first diagonal local spatial frequency computation $sB_{D1}$, and/or a second local spatial frequency computation $sB_{D2}$:

$$sB_H = |B_{M,N-2} - B_{M,N-1}| + |B_{M,N-1} - B_{M,N}| + |B_{M,N} - B_{M,N+1}| + |B_{M,N+1} - B_{M,N+2}| + |B_{M,N+2} - B_{M,N+3}|$$

$$sB_{V1*} = |B_{M-2,N} - B_{M-3,N}| + |B_{M-1,N} - B_{M-2,N}| + |B_{M,N} - B_{M-1,N}| + |B_{M+1,N} - B_{M,N}| + |B_{M+2,N} - B_{M+1,N}|$$

$$sB_{V2}^{\#} = B_{M-2,N} - B_{M-1,N}| + |B_{M-1,N} - B_{M,N}| + |B_{M,N} - B_{M+1,N}| + |B_{M+1,N} - B_{M+2,N}| + |B_{M+2,N} - B_{M+3,N}|$$

$$sB_{D1} = |B_{M-2,N+2} - B_{M-3,N+3}| + |B_{M-1,N+1} - B_{M-2,N+2}| + |B_{M,N} - B_{M-1,N+1}| + |B_{M+1,N-1} - B_{M,N}| + |B_{M+2,N-2} - B_{M+1,N-1}|$$

$$sB_{D2} = |B_{M-2,N-2} - B_{M-1,N-1}| + |B_{M-1,N-1} - B_{M,N}| + |B_{M,N} - B_{M+1,N+1}| + |B_{M+1,N+1} - B_{M+2,N+2}| + |B_{M+2,N+2} - B_{M+3,N+3}|$$

As should be appreciated, the two local spatial frequency calculations labeled with a * and the two that are labeled with a # sign that are computed will be those that had been selected for the gradient computation. For example, if the blue first gradient $dB_{V1*}$* has been selected, then the second red diagonal gradient $sR_{D2}$* would not have been selected, and therefore while the local spatial frequency $sB_{D1}$* will be computed, the second red diagonal local spatial frequency $sR_{D2}$* will not be computed.

For ease of explanation, the various local spatial frequency computations discussed above will be referred to below using the generic designation $s[R,G,B]_X$, where the x designates the particular gradient (i.e., H, V1, D1, D2, etc.), and R,[R,G,B] stands for R, G, or B, in the local spatial frequency computations above. In other words, the generic descriptor $s[R,G,B]_X$ may refer to $sR_V$, $sR_H$, $sR_{D1}$, $sR_{D2}$, $sG_V$, $sG_H$, $sG_{D1}$, $sG_{D2}$#, $sB_H$, $sB_1$*, $sB_2$#, $sB_{D1}$, or $sB_{D2}$, depending on the gradient that is being modified. Likewise, as used below, the notation $d[R,G,B]_X$ refers to the corresponding gradient. That is, $d[R,G,B]_X$ may refer to $dR_V$, $dR_H$, $dR_{D1}$, $dR_{D2}$*, $dG_V$, $dG_H$, $dG_{D1}$, $dG_{D2}$#, $dB_H$, $dB_1$*, $dB_2$#, $dB_{D1}$, or $dB_{D2}$, depending on the gradient that is being modified.

For each computed sum that indicates the local spatial frequency, $s[R,G,B]_X$, a corresponding modification factor $m[R,G,B]_X$ may be determined that can modify the corresponding gradient $d[R,G,B]_X$. This may be done through a function that can determine the modification factor m[R,G,B]x. One example can be a ramp function, as is described below. However, in other embodiments other functions may be used to determine the modification factor.

$$m[R,G,B]_X = \text{ramp_func}(s[R,G,B]_X)$$

Figure 20:
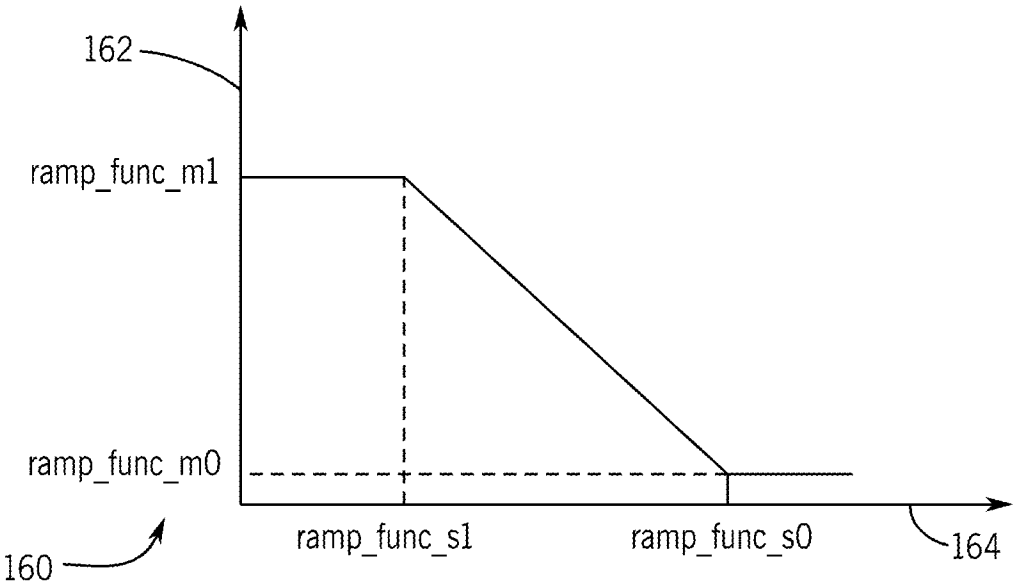
FIG. 20 is a diagram representing a ramp function that may be used to apply varying amounts of modification depending on the amount of local spatial frequency (LSF), in accordance with an embodiment.

The function may take any suitable functional form, and one form may be ramp_func($s[R,G,B]_X$), such as shown in FIG. 20 plot 160 of FIG. 20. In the plot 160, the modification value $m[R,G,B]_X$ output by the ramp function is shown along an ordinate 162. The input value of local spatial frequency, $s[R,G,B]_X$, is shown along an abscissa of 164. The ramp function of FIG. 20 is defined by 4 points. The maximum modification factor value, ramp_func_m1, a lowest modification factor value ramp_func_m0, a maximum threshold of local spatial frequency $s[R,G,B]_X$, ramp_func_s0, and a lowest threshold local spatial frequency $s[R,G,B]_X$, ramp_func_s1.

As may be appreciated, the ramp function is defined by four programmable parameters, ramp_func_m1, ramp_func_m0, ramp_func_s1, ramp_func_s0, as shown in FIG. 9. The ramp function may be computed as shown in the expression below. Thresholds ramp_func_s1, ramp_func_s0 may be u2.14 precision (or may be u3.14 precision when 5 gradients are summed) and parameters ramp_func_m1, ramp_func_m0 are u1.14 and u0.14 respectively. The parameter ramp_func_m1 may be limited to some maximum value in certain embodiments (e.g., a value of 16384, which is the equivalent of 1.0 in floating point representation). The function round(X,P) performs division of X by 2P with rounding away from zero. In order to avoid division in hardware, the slope of the ramp may be programmed as an s.4.14 number through a register that holds the variable ramp_func_slope. The computation for obtaining the slope may take place as shown in the expression below:

$$m[R,G,B]_x = \begin{cases} m1 & s[R,G,B]_x \le s1 \\ m1 + \text{round}((s[R,G,B]_x - s1) \times \text{slope}, 14) & \text{else} \\ m0 & s[R,G,B]_x \ge s0 \end{cases},$$

$$\text{slope} = \text{clip}\left(\left(\frac{m1 - m0}{s1 - s0}\right) \times 2^{14}, -2^{18} + 1, 2^{18} - 1\right)$$

In the expression above, (s[R,G,B]x−s1) may be u2.14 (or u3.14 when 5 gradients are summed) and subsequent to multiplication with the slope (which may have a precision of s.4.14) may results in an s.7.28 value, out of which s.1.14 may be retained. Subsequent to addition with m1, the result $m[R,G,B]_X$ may have u1.14 precision with a maximum value of 16384.

The result output by the resulting modification factor $m[R,G,B]_X$, may be multiplied by its corresponding gradient $d[R,G,B]_X$, to obtain a modified gradient $g[R,G,B]_X$. The modified gradient thus may be calculated according to the equation below:

$$g[R,G,B]_X = \text{round}(m[R,G,B]_X * d[R,G,B]_X, 14),$$

where the final results, $g[R,G,B]_X$, may have u0.14 precision.

Select Operation, LUT Interpolation, and Sub-Pixel Correction

Returning to the block diagram of the SPLC logic 46 shown in FIG. 10, the LSF-based modification logic 100A, 100B, . . . 100N may output the resulting modified gradient values $g[R,G,B]_X$ to the selection logic 102. The selection logic may select one of the modified gradient values $g[R,G,B]_X$ for each of the colors of sub-pixels 52. That is, the selection logic 102 may select $gR_V$, $gR_H$, $gR_{D1}$, or $gR_{D2}$* to determine a correction for determining the correction to the red sub-pixel; the selection logic 102 may select $gG_V$, $gG_H$, $gG_{G1}$, or $gG_{G2}$# for determining the correction to the green sub-pixel 52B; and the selection logic 102 may select $gB_H$, $gB_{B1}$*, $gG_{B2}$#, $gB_{D1}$, or $gB_{D2}$, for determining the modification to the blue sub-pixel 52C of the current pixel $P_{M,N}$.

The selection logic 102 may use any suitable selection criteria to select from among each of these red, green, and blue modified gradients. For instance, the selection logic 102 may use the following selection criteria: maximum, median, and minimum. The maximum, median, or minimum values can be externally programmable or may be programmed by default in the SPLC logic 46. If the median criteria is chosen, and there are an even number of modified gradient values $g[R,G,B]_{X\,x}$ for that particular color sub-pixel 52, the lower or smaller of the two middle entries may be selected in one embodiment. In other embodiments, the higher or larger of the two middle entries from a sorted set of the modified gradient values $g[R,G,B]_X$ for that color sub-pixel 52 may be selected. In the event that more than one modified gradient $g[R,G,B]_X$ has the same value as to match the correction criteria, the lowest-order lookup table (LUT) 104 may be chosen. This will be discussed further below.

For each of the color sub-pixels 52, the selection logic 102 thus may select a particular modified gradient value $g[R,G,B]_X$. Among the lookup tables (LUTs) 104, there may be one lookup table (LUT) 104 for each modified gradient value $g[R,G,B]_X$. For example, there may be 11 lookup tables for the modified gradient values $g[R,G,B]_X$ that could be selected:

$dR_V \rightarrow$LUT_0
$dR_H \rightarrow$LUT_1
$dR_{D1} \rightarrow$LUT_2
$dG_V \rightarrow$LUT_3
$dG_H \rightarrow$LUT_4
$dG_{D1} \rightarrow$LUT_5
$dB_H \rightarrow$LUT_6
$dB_{V1}$* or $dR_{D2}$* $\rightarrow$LUT_7
$dB_{V2}$# or $dG_{D2}$# $\rightarrow$LUT_8
$dB_{D1} \rightarrow$LUT_9
$dB_{D2} \rightarrow$LUT_10

The lookup tables LUT_0 thru LUT_10 may be ordered by the priority of least relative index, which may be used to affect which gradient values $g[R,G,B]_X$ are selected. For example, if $gR_V$=100, $gR_H$=100, and $gR_{D1}$=50, and the selection criteria is "max", $gR_V$ may be selected by the selection logic 102.

As noted above, computations may be independent for the red sub-pixel 52A, green sub-pixel 52B, and blue sub-pixel 52C. Since a separate LUT 104 is associated with each gradient of each sub-pixel (in this example, 11 LUTs 104 in total), the selection of the modified gradient value $g[R,G,B]_X$ also determines which LUTs 104 will be indexed by that gradient value $g[R,G,B]_X$. Since the computations are independent for each red, green, and blue sub-pixel 52, there may be a total of 3-look-up operations—one for each sub-pixel 52.

Each LUT 104 may use any suitable number of entries of any suitable spacing. In one example, each LUT 104 includes 17 equally spaced entries with each entry except the last having u0.10 precision. The last entry of each LUT 104 may have u1.10 precision but may be restricted to a maximum value of 1024 (which is the equivalent of 1.0 in floating point representation). Four MSBs of each selected modified gradient, $g[R,G,B]_{sel}$, may be used to index the corresponding selected LUT 104 and linear interpolation 106 between LUT 104 entries using the remainder 10-bits generates the gain value, gg[R,G,B], with u0.14 precision. This may take place as described below:

$$g[R,G,B]_{sel}=\text{select}(g[R,G,B]_X) \text{ // where } X\in\{H, V, V1, V2, D1, D2\} \text{ as appropriate for each sub-pixel}$$

$$\text{rem}=g[R,G,B]_{sel} \,\&\, 0x3ff$$
$$\text{idx}=g[R,G,B]_{sel}>>10$$
$$\text{low}=LUT_{[R,G,B]sel}[\text{idx}]$$
$$\text{high}=LUT_{[R,G,B]sel}[\text{idx}+1]$$
$$gg[R,G,B]=(((1024-\text{rem})+(\text{rem}*\text{high})+32)>>6$$

The SPLC logic 46 may use the computed gains gg[R,G,B] 112 to independently modify each sub-pixel 52 of the current pixel 50. The SPLC logic 46 may also consider a global scaling factor, gDPB, which may be a u0.10 value that can be programmed by software or predefined in hardware of the SPLC logic 46. The global scaling factor, gDPB, may be determined based on the brightness setting for the display 18, which, in turn, is a function of the user-brightness setting and ambient light sensing. The value of gDPB may be 1023 when display brightness is at its maximum and may drop for lower values of display brightness. The output pixel 94 values (which may have u0.14 precision) may be computed as follows based on the input current pixel 50 [R,G,B]in:

$$[R,G,B]\text{out}=(([R,G,B]\text{in}*(16384-(((gg[R,G,B]*gDPB)+512)>>10)))+8192)>>14$$

While the expression above has been provided by way of example, any other suitable expressions may be used to compute the output pixels 94, and the expression above is not meant to be the only way of using the gains 112 to determine the output pixels 94. Indeed, other expressions may or may not consider a global brightness value. Moreover, while the SPLC logic 46 discussed above performs sub-pixel layout compensation on a sub-pixel-by-sub-pixel basis, the SPLC logic 46 may consider gradients or local spatial frequencies relating to other colors of sub-pixels than the one that is modified.

Figure 21:
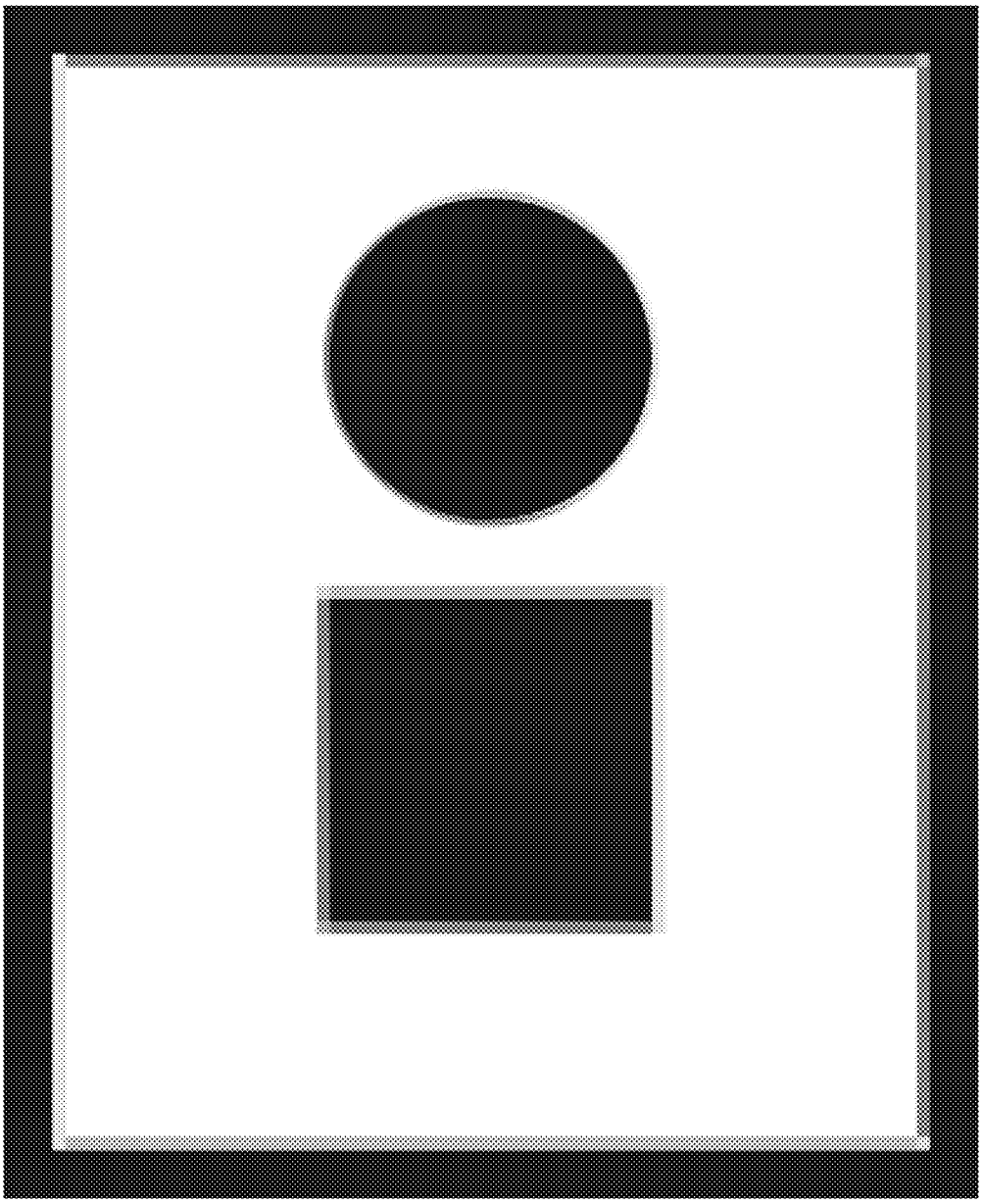
FIG. 21 is a schematic example of the image of FIG. 9 upon application of the sub-pixel layout compensation.

By adjusting the sub-pixel values as discussed above, sub-pixel layout artifacts (e.g., color fringing as shown in FIG. 10) may be reduced or eliminated. Indeed, FIG. 21 illustrates a corrected version of the image shown in FIG. 10. In FIG. 21, the color fringing artifacts attributable to the sub-pixel layout shown in FIG. 10 have been prevented from occurring by the SPLC logic 46.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic device comprising:

an electronic display comprising a matrix of pixels, each of the pixels comprising a respective plurality of sub-pixels of different respective colors;

a processor configured to generate image data to be displayed on the electronic display; and sub-pixel layout compensation circuitry configured to:

receive the image data;

adjust the image data on a sub-pixel-by-sub-pixel basis; and adjust a sub-pixel of a first color in a first pixel based at least in part on a first gradient between the sub-pixel of the first color of the first pixel and a sub-pixel of the first color of a second pixel, wherein:

the first pixel and the second pixel are along a first direction; and adjusting the sub-pixel of the first color of the first pixel reduces or eliminates an artifact due to a layout of the sub-pixels in the electronic display.

2. The electronic device of claim 1, wherein the sub-pixel layout compensation circuitry is configured to adjust the sub-pixel of the first color of the first pixel based at least in part on the first gradient between the sub-pixel of the first color of the first pixel and the sub-pixel of the first color of the second pixel, wherein the first pixel and the second pixel are directly adjacent to one another along the first direction.

3. The electronic device of claim 2, wherein the sub-pixel of the first color of the first pixel is disposed in the layout of the sub-pixels of the electronic display closer to the second pixel than to a third pixel disposed opposite the first pixel from the second pixel along the first direction.

4. The electronic device of claim 1, wherein the sub-pixel layout compensation circuitry is configured to adjust the sub-pixel of the first color of the first pixel based at least in part on the first gradient and a local spatial frequency among the sub-pixel of the first color of the first pixel, the sub-pixel of the first color of the second pixel, a sub-pixel of the first color of a third pixel, and a sub-pixel of the first color of a fourth pixel, wherein the third pixel and the fourth pixel are disposed along the first direction.

5. The electronic device of claim 4, wherein the third pixel is directly adjacent to the first pixel and the fourth pixel is directly adjacent to the second pixel.

6. The electronic device of claim 1, wherein the electronic display comprises a self-emissive display.

7. The electronic device of claim 1, wherein the sub-pixel layout compensation circuitry is configured to adjust a sub-pixel of a second color in the first pixel based at least in part on a second gradient between the sub-pixel of the second color of the first pixel and a sub-pixel of the second color of the second pixel, wherein adjusting the sub-pixel of the second color of the first pixel reduces or eliminates an artifact due to the layout of the sub-pixels in the electronic display.

8. The electronic device of claim 1, wherein the sub-pixel layout compensation circuitry is configured to adjust a sub-pixel of a second color in the first pixel based at least in part on a second gradient between the sub-pixel of the second color of the first pixel and a sub-pixel of the second color of a third pixel, wherein the first pixel and the third pixel are along a second direction different from the first direction, wherein adjusting the sub-pixel of the second color of the first pixel reduces or eliminates an artifact due to the layout of the sub-pixels in the electronic display.

9. A display backend for processing image data prior to display on an electronic display, wherein the display backend comprises image processing circuitry that comprises:

a pixel buffer configured to store a plurality of pixels;

gradient computation circuitry configured to compute, using the plurality of pixels, a first gradient between a sub-pixel of a first color of a first pixel of the plurality of pixels and a subpixel of the first color of a second pixel of the plurality of pixels, wherein first pixel and the second pixel are disposed along a first direction;

local-spatial-frequency-based modification circuitry configured to compute a first indicator of local spatial frequency along the first direction around the first gradient and to modify the first gradient based at least in part on the first indicator of local spatial frequency to produce a modified first gradient;

a first lookup table configured to be indexed based on the modified first gradient to provide a first sub-pixel modification factor; and sub-pixel layout compensation circuitry configured to modify the sub-pixel of the first color of the first pixel based on the sub-pixel modification factor.

10. The display backend of claim 9, wherein the gradient computation circuitry computes the first gradient independently of other sub-pixels of the first pixel.

11. The display backend of claim 9, wherein the local-spatial-frequency-based modification circuitry computes the first indicator of local spatial frequency independently of other sub-pixels of the first pixel.

12. The display backend of claim 9, wherein the pixel buffer is configured to store no more than six lines of pixels and wherein the local-spatial-frequency-based modification circuitry is configured to compute the first indicator of the local spatial frequency based on sub-pixels of pixels in the no more than six lines of pixels.

13. The display backend of claim 9, wherein the second pixel is one of a plurality of directly adjacent neighbors of the first pixel, and wherein the sub-pixel of the first color of the first pixel is located closer to an edge of the second pixel than to an edge of another pixel of the directly adjacent neighbors of the first pixel.

14. The display backend of claim 9, wherein the local-spatial-frequency-based modification circuitry computes the first indicator of local spatial frequency based on a sum of at least four gradients of pixels along the first direction and including the computed gradient.

15. The display backend of claim 9, wherein the local-spatial-frequency-based modification circuitry is configured to modify the first gradient to result in comparatively less modification of the sub-pixel when the first indicator of local spatial frequency indicates a higher local spatial frequency and to modify the first gradient to result in comparatively greater modification of the sub-pixel when the first indicator of local spatial frequency indicates a lower local spatial frequency.

16. The display backend of claim 9, wherein the sub-pixel layout compensation circuitry is configured to modify the sub-pixel of the first color of the first pixel based on the sub-pixel modification factor and a global scaling brightness factor.

17. A display backend for processing image data prior to display on an electronic display, wherein the display backend comprises image processing circuitry that comprises:

gradient calculation circuitry configured to calculate a plurality of gradients between a current pixel and a local 3×3 neighborhood of pixels directly around the current pixel, wherein each of the plurality of gradients is specific to a single color of sub-pixel, and wherein the plurality of gradients comprises:

a plurality of red gradients to a red sub-pixel of the current pixel;

a plurality of green gradients to a green sub-pixel of the current pixel; and a plurality of blue gradients to a blue sub-pixel of the current pixel; and sub-pixel layout compensation circuitry configured to:

independently modify the red sub-pixel of the current pixel based at least in part on a selected one of the plurality of red gradients;

independently modify the green sub-pixel of the current pixel based at least in part on a selected one of the plurality of green gradients; and independently modify the blue sub-pixel of the current pixel based at least in part on a selected one of the plurality of blue gradients.

18. The display backend of claim 17, wherein each of the plurality of red gradients to the red sub-pixel of the current pixel comprises a gradient to the red sub-pixel from one of a first subset of direct neighbors of the current pixel, wherein the red sub-pixel of the first pixel is located closer to edges of the first subset of direct neighbors than to edges of a second subset of direct neighbors that are located on an opposite side of the current pixel from the first subset of neighbors.

19. The display backend of claim 17, comprising local-spatial-frequency-based modification circuitry configured to calculate a respective local spatial frequency for each of the gradients when the gradients are positive and modify each of the gradients according to the respective local spatial frequency, wherein the sub-pixel layout compensation circuitry is configured to:

independently modify the red sub-pixel of the current pixel based at least in part on the selected one of the plurality of red gradients as modified by the local-spatial-frequency-based modification circuitry;

independently modify the green sub-pixel of the current pixel based at least in part on a selected one of the plurality of green gradients as modified by the local-spatial-frequency-based modification circuitry; and independently modify the blue sub-pixel of the current pixel based at least in part on a selected one of the plurality of blue gradients as modified by the local-spatial-frequency-based modification circuitry.

20. The display backend of claim 17, wherein the sub-pixel layout compensation circuitry is followed by panel response correction circuitry configured to perform further modification to correct for panel response mismatch of the electronic display.

* * * * *